US011149760B2

(12) United States Patent
Lee et al.

(10) Patent No.: US 11,149,760 B2
(45) Date of Patent: Oct. 19, 2021

(54) PISTONLESS CYLINDER

(71) Applicants: James Jun Lee, Katy, TX (US); William Wei Lee, Arcadia, CA (US)

(72) Inventors: James J. Lee, Richmond, TX (US); William W. Lee, Arcadia, CA (US)

( * ) Notice: Subject to any disclaimer, the term of this patent is extended or adjusted under 35 U.S.C. 154(b) by 0 days.

(21) Appl. No.: 16/960,829

(22) PCT Filed: Aug. 21, 2019

(86) PCT No.: PCT/IB2019/057042
§ 371 (c)(1),
(2) Date: Jul. 8, 2020

(87) PCT Pub. No.: WO2020/115573
PCT Pub. Date: Jun. 11, 2020

(65) Prior Publication Data
US 2021/0054856 A1 Feb. 25, 2021

(51) Int. Cl.
*F15B 15/10* (2006.01)

(52) U.S. Cl.
CPC ..... *F15B 15/10* (2013.01)

(58) Field of Classification Search
CPC ..... F15B 15/10; F15B 2215/305; F15B 2211/7053; F15B 2211/7052; F15B 15/1428; F15B 15/203; F15B 2201/3151; F15B 2201/315
See application file for complete search history.

(56) References Cited

U.S. PATENT DOCUMENTS 10,145,081 B1 * 12/2018 Lee ..... E02D 27/525
10,465,724 B2 * 11/2019 Lee ..... F15B 15/10

* cited by examiner

*Primary Examiner* — Abiy Teka
*Assistant Examiner* — Daniel S Collins
(74) *Attorney, Agent, or Firm* — Xinsheng Wang

(57) ABSTRACT

An improved pistonless cylinder, including both single acting and double acting configurations, based on an Aramid fiber reinforced elastomer tubular which is highly stiff in radial direction against radial expansion and elastic in axial extension, so as to form a completely sealed, extendable and retractable pressure chamber and to be able to perform as well as, or better than, most of the conventional hydraulic cylinders in terms of load bearing capacities, maximum stroke distances and service durability. This improved cylinder employs no piston, piston rod, sealing seals or oil based hydraulic fluid, and utilizes non-metal materials to construct the majority of the parts for its extendable and retractable pressure chamber; therefore, this new cylinder can achieve significant weight and fabrication cost reduction. In addition, this new pistonless cylinder uses ordinary liquids, e.g., fresh water or seawater, as its hydraulic fluid, and can work directly as a hydraulic or pneumatic cylinder interchangeably without a need for much, if any, modification.

20 Claims, 11 Drawing Sheets

PISTONLESS CYLINDER

FIELD

The disclosure relates generally to a new load bearing and power transmission device, which employs no piston, no piston rod, no sealing rings and no oil based hydraulic fluid.

BACKGROUND

A Conventional Hydraulic Cylinder

Conventional hydraulic cylinder was first introduced as a hydraulic press using water as its transmission medium in 1795. In 1905, oil-based transmission medium was first introduced as transmission medium of a hydraulic cylinder. There have been no significant changes in basic hydraulic cylinder configuration ever since.

A typical conventional double acting hydraulic cylinder comprises five key components:

1. A piston with its sliding action to separate a pressure chamber between a pressurized portion and an unpressurized portion;
2. A piston rod connected to the piston sliding in and out of the pressure chamber to convert hydraulic energy to mechanical energy;
3. A barrel for housing all cylinder components and for providing sliding surfaces for all cylinder sliding components against its inner surfaces;
4. O-ring sliding seals to perform sealing function to prevent hydraulic fluid from leakage during the piston rod movement in and out of the pressure chamber; and
5. Oil-based hydraulic fluid serving primarily as transmission medium and secondarily as lubricant for O-ring sliding seals.

Conventional hydraulic cylinder is a mature, and widely accepted technology. Nevertheless, it has some serious weaknesses. Firstly, all conventional hydraulic cylinders must be equipped with sliding seals to prevent leakage of hydraulic fluid. Such seals, mostly made of elastomer materials, are the most vulnerable part of a conventional hydraulic cylinder, as such seals are wearing prone and so need replacement periodically. Seal malfunction is by far the most important cause for almost all failures of conventional hydraulic cylinders, often resulting leakage of hydraulic fluid and environmental pollution. It is noteworthy that global annual consumption of oil-based hydraulic fluids is in several million tons, constituting a serious source of environmental pollution across the world. This weakness of seals in conventional hydraulic cylinder has become more and more pronounced today, because requirements for environmental protection are increasingly demanding in all industries.

Over the years, several attempts have been made to introduce various new concepts of hydraulic cylinders without using piston, piston rod, sealing rings or oil based hydraulic fluid. Some examples are as follows.

An Expandable Cylinder

"Expandable Cylinder" was first introduced in U.S. Pat. No. 6,427,577 issued to Lee et al. on Aug. 22, 2002. The basic concept of this new type of hydraulic cylinder is derived from offshore marine shock cells, which passively absorb impact loads during docking operations between a vessel and an offshore structure. Such shock cells have been widely and successfully deployed in offshore applications for decades.

A typical marine shock cell comprises an inner steel tubular and an outer steel tubular with a larger diameter, co-axially placed with an annular gap between the two tubulars. An elastomer annulus, which commonly uses mixtures of natural rubber to achieve better rubber to steel bonding characteristics, is installed within the annular gap bonded to the outer surface of the inner tubular and the inner surface of the outer tubular via a vulcanization process. When a compression force is applied at the front end of the inner tubular, the shock cell induces relative deflection between the inner tubular and the outer tubular under a shear dominant loading condition. Once the compression force disappears, the elastomer annulus will automatically return to its original deflection free configuration. In accordance with one embodiment of the above mentioned disclosure, this passive load bearing device such as a marine shock cell could be converted into an active loading bearing device, such as a load bearing fluid power device, by adding two cap plates, one at the inner tubular and the other one at the outer tubular, to form a completely sealed pressure chamber for housing transmission medium, functioning similarly to a simple conventional hydraulic cylinder.

The Expandable Cylinder as mentioned above is an active load bearing hydraulic cylinder by converting a marine shock cell into a simple hydraulic cylinder composed of these items: 1) one outer tubular and one co-axially placed inner tubular inside the outer tubular with an annular gap in between; 2) an annular elastomer annulus placed inside the annular gap with its inner surface bonded with the outer surface of the inner tubular and with its outer surface bonded with the inner surface of the outer tubular; and 3) a pair of end cap closures with one closure installed at the inner surface of the inner tubular and the other closure installed at the inner surface of the outer tubular in order to form a completely sealed pressure chamber. Under this configuration, there is no piston, piston rod, sealing rings or oil based hydraulic fluid inside the pressure chamber, and instead ordinary water can be used as the cylinder transmission medium.

Once ordinary water is injected into the pressure chamber of the Expandable Cylinder, the bonded elastomer annulus, or called "an expandable joint" in the above mentioned patent, will bulge out within the space of the annular gap under a shear dominant loading condition to provide relative displacement between the inner cylinder and the outer cylinder as the stroke distance of the Expandable Cylinder. Based on the proposed configuration of one Expandable Cylinder unit, described in the above-mentioned patent, the maximum stroke distance of each unit is limited because the maximum stroke is dependent on the annular gap size of the annular elastomer annulus. One solution to increase the maximum stroke distance, in accordance with one embodiment of the above-mentioned disclosure, is to arrange a plurality of expandable joints end to end in a serial configuration, so as to achieve the desired long stroke distance.

Nerveless, another shortfall of the Expandable Cylinder is its inner pressure loading limitation, mostly due to the annular elastomer annulus loading capacity under a shear dominate loading condition. It should be pointed out that any elastomer structure is the most vulnerable to shear stress, while enjoying the highest resistance to compression stress, and to a less degree, to tensile stress. A model test was conducted, for the confirmation of an Expandable Cylinder, to confirm that the maximum pressure loading capacity of the model and that the failure mode is due to shear stresses acting on the annular elastomer annulus.

A Pistonless Cylinder

In U.S. Pat. No. 10,145,081 issued to Lee et al. on Dec. 4, 2018, a new configuration of hydraulic cylinder, called "Pistonless Cylinder", was introduced, in which employed annular elastomer seals are under compression and tensile dominant loading with little shear loading. Moreover, the maximum tensile stress inside these elastomer annuli is capped to a small and fixed degree and, in general, is independent of the maximum pressure undertaken. Therefore, such newly configured cylinders are sturdier, more reliable, and safer, because they are able to take much higher internal pressure than those Expandable Cylinders as described above. Nevertheless, maintaining the same objectives as to Expandable Cylinders mentioned earlier, Pistonless Cylinders employ no piston, piston rod, sealing rings or oil based hydraulic fluid inside a pressure chamber and use ordinary water as cylinder transmission medium.

A basic Pistonless Cylinder unit, in accordance with one embodiment of the disclosure as mentioned above, comprises the following components:

1. A pair of one-side curved annular elastomer seals with bonding connections is placed between the annular elastomer seal outer surfaces and a pair of outer tubular inner surfaces, respectively. The inner surfaces of the annular elastomer seals are bonded at two ends of the outer surface of a common inner cylinder, respectively;

2. A ring shim plate, with the common inner cylinder outer surface passing through a shim plate central hole, is placed between the pair of outer cylinders;

3. A front head, functioning as a front cap closure plate, is connected to the front cylinder of the pair outer cylinders and an end cap closure plate is connected to the end cylinder of the pair outer cylinders, respectively, to form a completely sealed pressure chamber; and 4. A barrel provides a space for housing the above listed items and provides a unidirectional guidance and traveling distance control of the front head.

Once ordinary water is injected initially into the pressure chamber of a pistonless cylinder, the two bonded elastomer seals start to bulge out against the shim plate side surfaces and the two outer cylinder inner surfaces, respectively. During the initial expansion of the two elastomer seals and the extension of the front head, the two bonded elastomer seals are mostly under a limited shear stress loading condition. As the chamber internal pressure increases and the front head unidirectionally extends more, the two elastomer seals shall be fully expanded against the shim plate side surfaces and the two outer cylinder inner surfaces, respectively. Under this pressure loading condition, the seals are under compression dominate loading condition and the maximum tensile stress inside these elastomer seals is capped to a small and fixed degree and, in general, is independent of the maximum pressure undertaken. Therefore, the Pistonless Cylinders are sturdier, more reliable, and safer, because they are able to take much higher internal pressure than the Expandable Cylinders described above.

The Pistonless Cylinders satisfy all above-mentioned objectives: employing no any piston, piston rod, sealing rings or oil based hydraulic fluid inside a pressure chamber and using ordinary water as cylinder transmission medium. However, the functionalities of the Pistonless Cylinder still impose shortfalls in two areas: 1) the maximum stroke distance of a Pistonless Cylinder is still not long enough comparing to a conventional hydraulic cylinder, when both have the same cylinder length. One solution for increasing the stroke length is to put a plurality of basic pistonless cylinder units together in a serial configuration, in accordance with one embodiment of the Pistonless Cylinder; and 2) the proposed Pistonless Cylinder configuration does cap the maximum tensile stresses and shear stresses inside these two elastomer seals, and the maximum inner pressure force is taken by these two elastomer seals in the form of compression forces against the shim plate side surface and the outer cylinder inner surfaces, respectively. Consequently, the proposed configuration of the Pistonless Cylinder does eliminate sliding seals inside the pressure chamber; however, the configuration creates two annular sliding surfaces, between each elastomer seal outer surface and the corresponding outer cylinder inner surface, outside the pressure chamber. These sliding surfaces have the potential to create a large friction force against the front head movements.

An Improved Pistonless Cylinder

The Improved Pistonless Cylinder, in the present disclosure, is an improved version of the Pistonless Cylinder through the introduction of a simplified configuration for the sealed pressure chamber of the cylinder. The Improved Pistonless Cylinder provides three noticeable advantages as follows: 1) the Improved Pistonless Cylinder not only eliminates all sliding surfaces or friction forces inside its extendable pressure chamber, but also reduces or totally eliminates extendable pressure chamber induced friction forces outside of its pressure chamber; 2) the cylinder total forward maximum extension distance is similar or better than most conventional hydraulic cylinders, when both have the same original cylinder length; and 3) the simplified configuration of the Improved Pistonless Cylinder helps to provide a double acting cylinder configuration, which functions comparable to conventional double acting hydraulic cylinders. With these advantages, the Improved Pistonless Cylinder is able to perform as well as, or better than, most of the conventional hydraulic cylinders for different field applications.

OBJECTIVES AND SUMMARY

The principal objective of the disclosure is to introduce the Improved Pistonless Cylinder, which is able to form at least one completely sealed and extendable pressure chamber and to perform similar or better than most of conventional hydraulic cylinders in terms of load bearing capacities, maximum stroke distances and service durability.

One additional objective of the Improved Pistonless Cylinder is that the Improved Pistonless Cylinder's total weight can be significantly less than a comparable conventional hydraulic cylinder when both cylinders have a similar cylinder length and capacity. In addition, the weight increase of the Improved Pistonless Cylinder is insensitive to the increase of the cylinder's internal pressure.

One more additional objective is to introduce the Improved Pistonless Cylinder configuration in order to significantly reduce the radial expansion of a pistonless cylinder extendable pressure chamber.

Another objective is that through the configuration t of the Improved Pistonless Cylinder, a double acting configuration is introduced to a Pistonless cylinder.

BRIEF DESCRIPTION OF THE DRAWINGS

The drawings described herein are for illustrating purposes only of selected embodiments and not all possible implementations, and are not intended to limit the scope of the present invention. For further understanding of the nature and objects of this disclosure reference should be made to the following description, taken in conjunction with the accompanying drawings in which like parts are given like reference signs, and wherein:

FIG. 2C-1 illustrates one alternative wrapping pattern, different from the one shown in FIG. 2C, for coil-like Aramid fibers evenly spaced inside elastomer layers criss-crossing with each adjacent Aramid fiber layer at a small angle, where all fibers arranged into two different configurations, one single string or several ones woven together into a strip, in accordance with one embodiment;

DETAILED DESCRIPTION

Before explaining the disclosure in detail, it is to be understood that the system and method is not limited to the particular embodiments and that it can be practiced or carried out in various ways.

In accordance with one embodiment of the present disclosure, figures from FIG. 1A through FIG. 1D illustrate key configurations of the Improved Pistonless Cylinder assembly with an installed friction reduction device and a radial pressure restrained device inside an elastomer tubular, both in a pre-activation position and in a fully extended position.

Based on the basic friction force calculation formula, $F=N\times f$, where, F is the total friction force, N is the total compression force at the contact surface, and f is the friction coefficient of the contact surface. Therefore, the intended friction reduction device shall do both: 1) utilizing a radial pressure restrained device to reduce the contact compression force at the contact surface. In other words, the contact pressure force from elastomer tubular outer surface should be significantly reduced compared with the pressure force acting at the elastomer inner surface; and 2) utilizing a friction reduction device by changing contact sliding surface property from a rubber-to-steel contact surface to a plastic-to-plastic contact surface with a significantly reduced friction coefficient at the sliding surface.

Figure 1A:
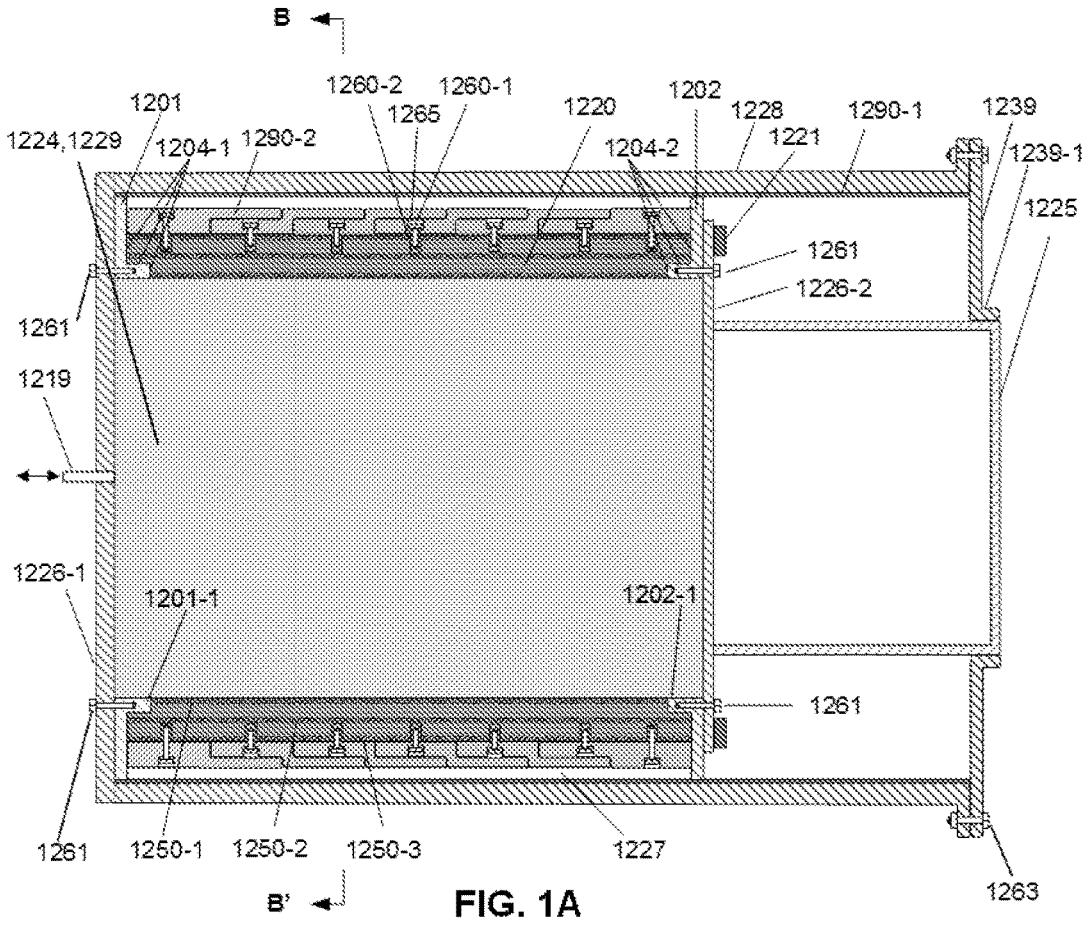
FIG. 1A illustrates a cross section view of a single acting configuration of the Improved Pistonless Cylinder assembly in a pre-activation position in accordance with one embodiment.

Referring to FIG. 1A, the cross section view shows the basic configuration of the Improved Pistonless Cylinder assembly. The cylinder can be assembled in the following steps in accordance with one embodiment:

1. A pair of ring plates 1201 and 1202 with horizontal shorter arms of the L-shape cross section 1201-1 and 1202-1 are connected to the two ends of an elastomer tubular 1220 through a vulcanization process to form bonded connections 1204-1 and 1204-2. A plurality of short steel pipes with closed bottoms, each with a pre-installed nut 1260-2 inside, are buried and bonded with rubber material inside the elastomer tubular 1220 near the tubular outer surface during the vulcanization process.

2. A radial pressure restrained device comprises a plurality of Aramid fiber layers 1250-1, 1250-2 and 1250-3, each layer placed between two thin rubber layers. Each Aramid fiber layer is composed of one single continuous string of Aramid fiber wrapped in a coil-like pattern around an annular thin rubber layer surface of the elastomer tubular 1220 from one end to the other end with a designed offset relative to the adjacent layer of Aramid fibers above or below. The bonding process between the Aramid fibers and the rubber layers is through the same vulcanization process as mentioned above.

3. A friction reduction device is made of a plurality of curved UHMWPE plates 1290-2 with one plate being able to slide at the surface of another plate both longitudinally and annularly. There is no gap between any two UHMWPE plates 1290-2 in longitudinal and annular directions in a pre-activation position. Each UHMWPE plate 1290-2 has one circular recess 1260-1 used for housing the bolting 1265 connection with one buried nut 1260-2 inside the elastomer tubular 1220, which has an outer surface curvature matching the corresponding UHMWPE plate 1290-1 inner surface and an inner surface curvature matching the elastomer tubular 1220 outer surface. With the installation of the radial pressure restrained device and the friction reduction device in the assembled elastomer tubular 1220, it forms an unidirectionally extendable unit as the key power transmission element of the Improved Pistonless Cylinder.

4. A barrel 1228 is pre-connected with an end cap plate 1226-1, which has a pre-installed supply pipe 1219, and then a UHMWPE tubular 1290-1 is inserted inside the barrel 1228 for friction reduction purpose. A front cap plate 1226-2 is connected with a pre-installed rubber ring plate 1221 and a front head 1225. A traveling control system for the front head 1225 comprising: 1) a ring plate 1239 with a L-shape cross section 1239-1 as a guide for the front head 1225 front extension and retraction; and 2) an installed rubber ring plate 1221 in combination with the ring plate 1239 to serve as a stopper for the maximum stroke distance of the unidirectional extendable tubular.

5. The final assembly of the Improved Pistonless Cylinder is in the following order in accordance with one embodiment: 1) insert the unidirectionally extendable unit inside the barrel 1228 until one end touches the end cap plate 1226-1; 2) utilize a plurality of bolted connections 1261 to form a sealed connection between the end cap plate 1226-1 and the ring plate 1201; 3) utilize a plurality of bolted connections 1261 to form a sealed connection between the front plate 1226-2 and the ring plate 1202; and 4) finally, utilize a plurality of bolted connections 1263 to connect the ring plate 1239 with the barrel 1228 front end to form a completely sealed and unidirectionally extendable chamber 1224 with transmission medium 1229 to fill the chamber 1224. The final assembly shall have a designed annular gap 1227 between the UHMWPE plates 1290-2 outer surface and the UHMWPE tubular 1290-1 inner surface to provide a radial space for the potential radial expansion of the completely sealed extendable chamber. The installed supply pipe 1219 is connected to an outside device for injection and withdrawal of the transmission medium 1229 inside the chamber 1224. If the transmission medium 1229 is air injected by an air compressor, the pistonless cylinder then becomes a pneumatic cylinder. If the transmission medium is water injected by a pump, then the Improved Pistonless Cylinder is a hydraulic cylinder.

UHMWPE plate has excellent properties for anti-wearing and for providing low friction coefficient, as mentioned earlier. Therefore, it is ideal to use it as the basic material for the friction reduction device.

Aramid fiber layers 1250-1, 1250-2 and 1250-3 can be easily bonded with nature rubbers during a vulcanization process. In addition, Aramid fibers also have exceptionally good properties in anti-tension stress and anti-shear stress. With tension stress, an Aramid fiber is much stronger in performance than a steel fiber when the two have the same O.D. size as evidenced by the fact that Aramid fibers can be used for fabrication of a bulletproof vest. When used for the radial pressure restrained device, Aramid fiber layers 1250-1, 1250-2 1250-3 bonded with nature rubber layers enable the elastomer tubular 1220 to only have a unidirectional elasticity, that has a low longitudinal stiffness for easy extension of the elastomer tubular 1220 just like nature rubber on the one hand, and exceptionally high stiffness in radial direction as tightly restrained by the coil-like Aramid fiber layers in order to force an omni-directionally expandable pressure chamber to become a unidirectionally extendable pressure chamber.

Figure 1B:
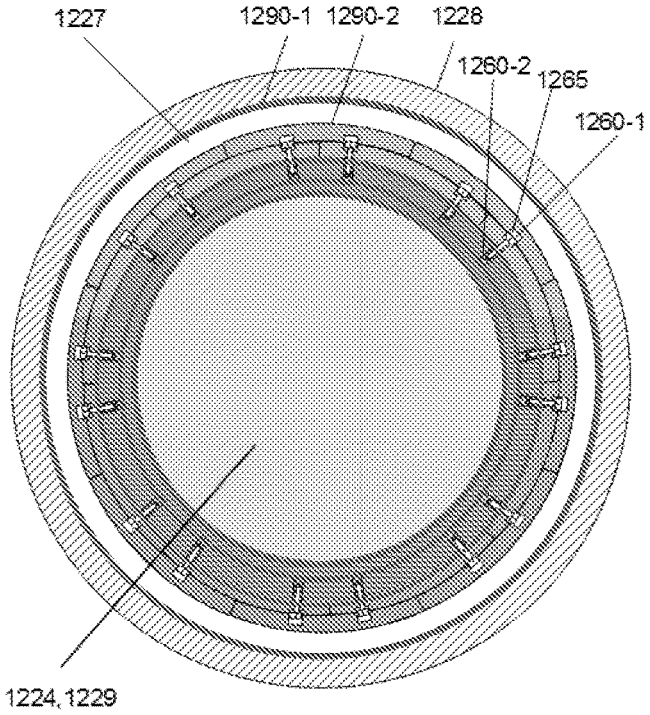
FIG. 1B illustrates the B-B' cross section view, shown in FIG. 1A, of a configuration of the Improved Pistonless Cylinder assembly in a pre-activation position, in accordance with one embodiment.

Referring to FIG. 1B, a B-B' cross section view shown in FIG. 1A with the Improved Pistonless Cylinder in a pre-activation position. There is no longitudinal gap between any two UHMWPE plates 1290-2.

Figure 1C:
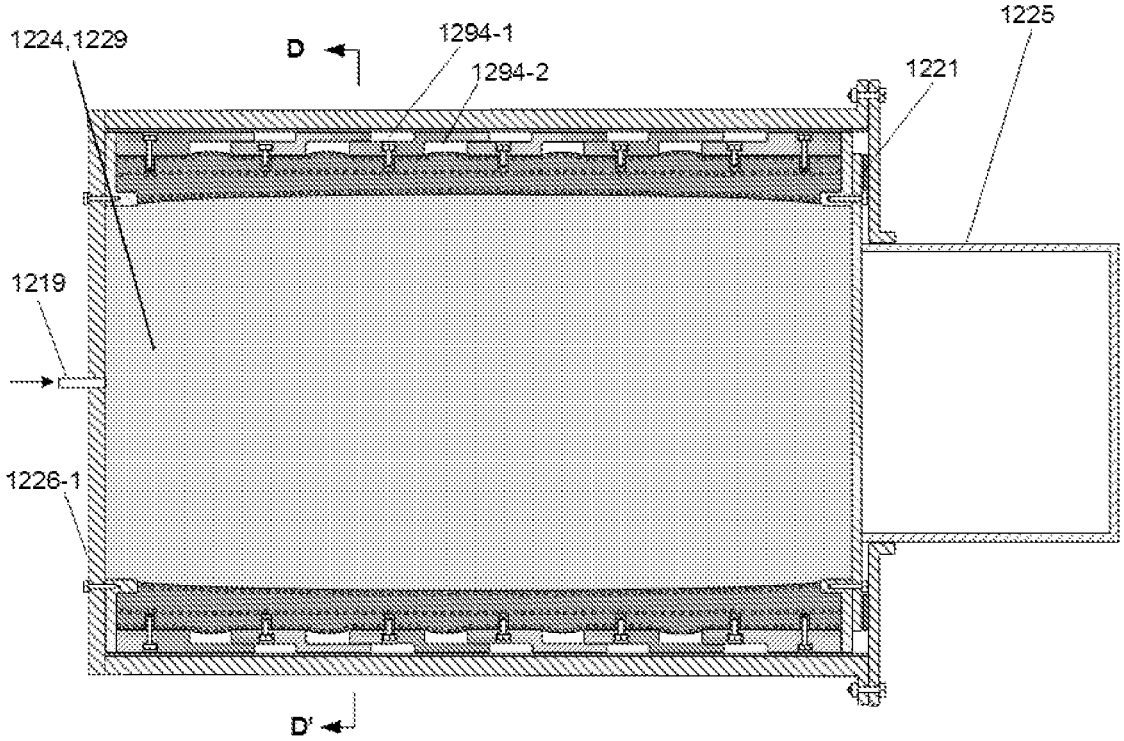
FIG. 1C illustrates a cross section view of the single acting configuration of the Improved Pistonless Cylinder assembly in a fully extended position in accordance with one embodiment.

Referring to FIG. 1C, a cross section view to show the Improved pistonless Cylinder in a fully extended position. There are longitudinal gaps 1294-1 and 1294-2 between any two UHMWPE plates 1290-2 due to the elastomer tubular longitudinal expansion.

Figure 1D:
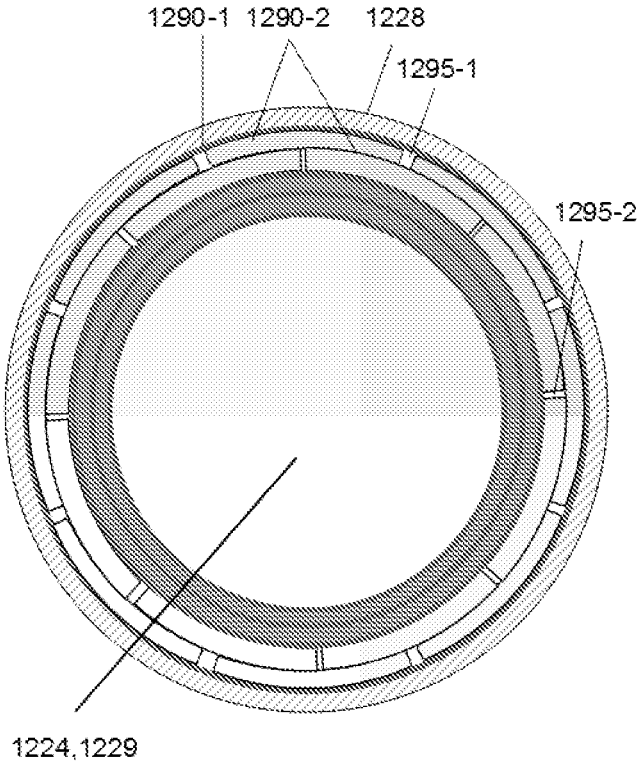
FIG. 1D illustrates the D-D' cross section view, shown in FIG. 1C, of a configuration of the Improved Pistonless Cylinder assembly, in a fully extended position, in accordance with one embodiment.

Referring to FIG. 1D, a D-D' cross section view shown in FIG. 1C with the Improved Pistonless Cylinder in a fully extended position. There are annular gaps 1295-1 and 1295-2 between any two UHMWPE plates 1290-2 due to the elastomer tubular radial expansion.

In accordance with one embodiment of the present disclosure, figures from FIG. 2A through FIG. 2D illustrate key variants of the configuration of the Improved Pistonless Cylinder assembly which is similar to the one shown in FIG.1A, except for deletion of the friction reduction device, thus being the optimal approach to further simplify the whole system. In addition, different Aramid fiber coil-like wrapping patterns are introduced in accordance with one embodiment.

Figure 2A:
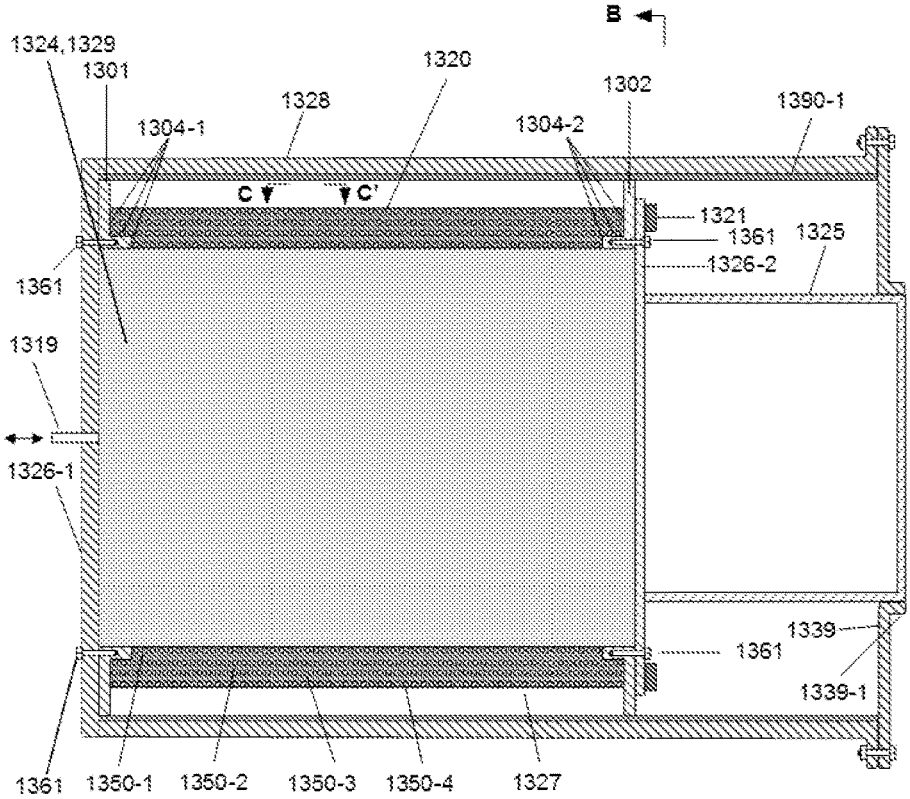
FIG. 2A illustrates a cross section view of a single acting configuration of the Improved Pistonless Cylinder assembly in a pre-activation position, similar to the one shown in FIG. 1A with such changes as deletion of the friction reduction device, except a plastic tubular against barrel inner surface for friction reduction purpose, increase of the annular gap width and enhancement of the radial pressure restrained device in order to avoid any contact between the elastomer tubular outer surface and the barrel inner surface in accordance with one embodiment.

FIG. 2A illustrates a cross section view of a single acting configuration of the Improved Pistonless Cylinder assembly in a pre-activation position, similar to the one shown in FIG. 1A with such changes as deletion of the friction reduction device, increase of the annular gap width 1327, which is open to surroundings, and enhancement of the radial pressure restrained device with one additional Aramid fiber layer 1350-4 in addition to Aramid fiber layers 1350-1, 1350-2 and 1350-3 inside the elastomer tubular 1320 in order to avoid any contact between the elastomer tubular 1320 outer surface and the UHMWPE tubular 1390-1 inner surface under the maximum designed internal pressure in accordance with one embodiment.

Figure 2B:
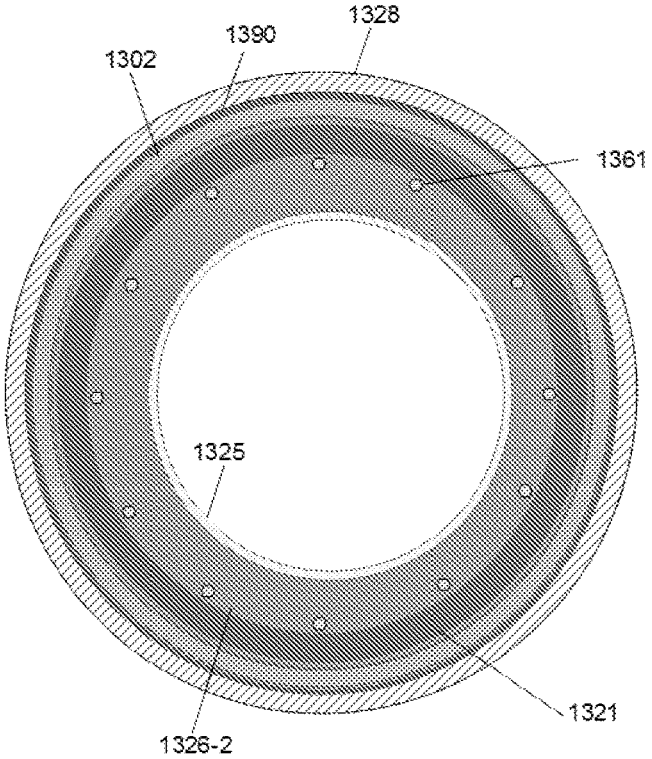
FIG. 2B illustrates the B-B' cross section view of the Improved Pistonless Cylinder assembly, without a friction reduction device, shown in FIG. 2A and in a pre-activation position, in accordance with one embodiment.

Referring to FIG. 2B, a B-B' cross section view shown in FIG. 2A with the Improved Pistonless Cylinder in a pre-activation position. There are 12 bolts 1361 used to connect the front plate 1326-2 and the ring plate with a L-shape section 1302 to form a sealed connection and to form a completely sealed and unidirectionally extendable chamber in accordance with one embodiment.

Figure 2C:
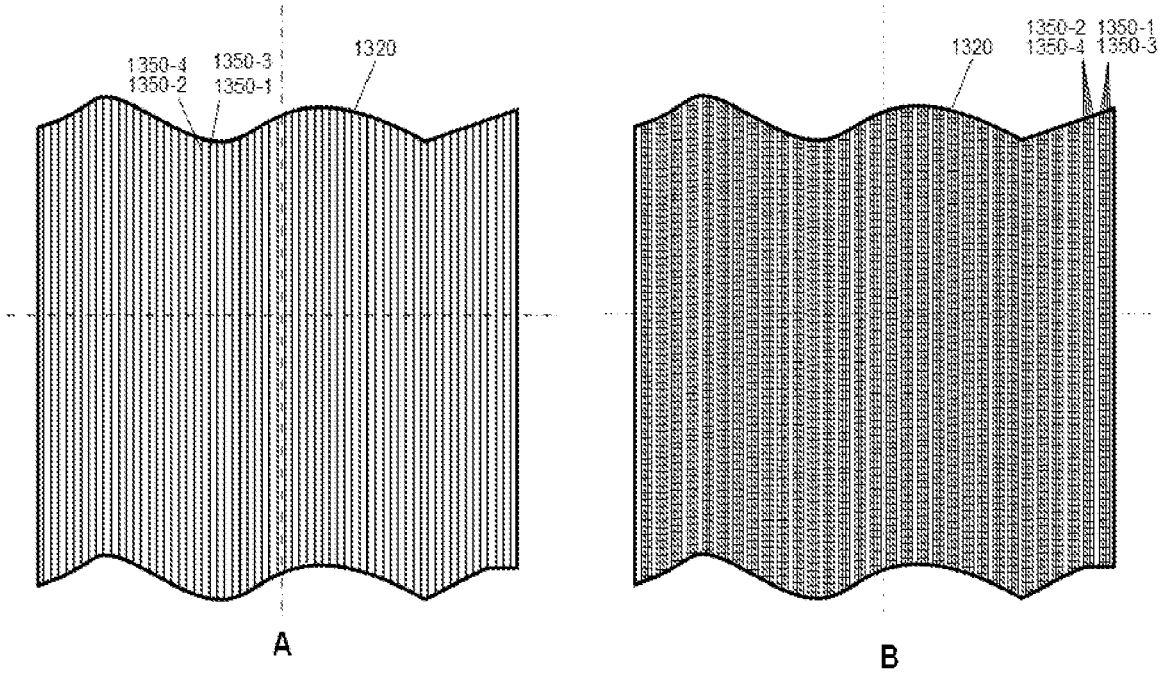
FIG. 2C illustrates the enlarged C-C' cut-off section view in FIG. 2A to show a basic coil-like wrapping pattern of Aramid fibers, which are evenly spaced inside an elastomer layer with each layer in a parallel configuration with a designed small offset relative to adjacent fiber layer above or below, where all fibers arranged into two different configurations, one single string or several ones woven together into a strip, in accordance with one embodiment.
Figures 1, 2C:
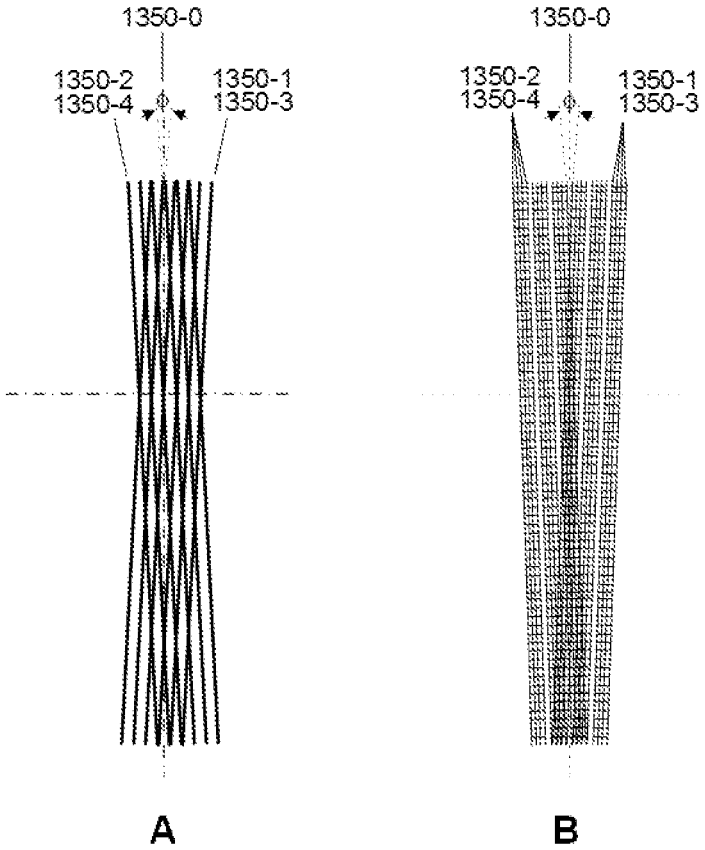

There are two different coil-like wrapping patterns for an Aramid fiber layer around an annular rubber layer surface of the elastomer tubular 1320, as described separately in FIG. 2C through FIG. 2C-1. There are three critical objectives in selecting a proper wrapping pattern to suit each different application: 1) to minimize bulging and prevent leakage from the rubber between Aramid fibers within the same Aramid fiber layer, especially in a fully extended position of the elastomer tubular; 2) to best control the stiffness distribution of the elastomer tubular both in longitudinal direction and in radial direction; and 3) the wrapping pattern has to provide a good bonding characteristic between each Aramid fiber and nature rubber during a vulcanization process in accordance with one embodiment.

Referring to FIG. 2C, this wrapping pattern is called the parallel pattern where all fibers, one single string in FIG. 2C-A or several ones woven together into a strip in FIG. 2C-B where four stings woven together into a strip, are wrapped in a parallel configuration not only in the same Aramid fiber layer, but also in the adjacent Aramid fiber layers above or below. However, all the Aramid fiber layers should be arranged in such a way that the Aramid fibers of each layer will cover the gaps with a horizontal offset between the Aramid fibers of the adjacent layers above or below. Therefore, such configuration will help minimize bulging of the rubber as well as the risk of leakage, while ensuring maximum elasticity in the longitudinal direction. It should be pointed out that several Aramid fiber strings woven into a wider strip will make it harder for such strip to slip out of the rubber layer bonded with.

Referring to FIG. 2C-1, this wrapping pattern is called the small-angle crisscrossing pattern where all fibers, one single string in FIG. 2C-1-A or several ones woven together into a strip shown in FIG. 2C-1-B where four stings woven together into a strip, in each Aramid fiber layer is arranged with a small angle 1350-0 relative to the adjacent Aramid fiber layer above or below. In other words, Aramid fibers in one layer will crisscross at a small angel (usually less than 8 degrees) with those in the adjacent layers. Such configuration will prevent any bulging or leakage of the rubber tubular, while adding a little stiffness in the longitudinal direction.

Alternative material such as one single string of steel wire or several ones connected together into a strip to replace the Aramid fibers, can be wrapped both in the parallel configuration and a small-angle crisscrossing pattern as mentioned above. In tire industry, bonding steel wires or steel nets inside a rubber tire has become a common practice with developed streel wire to nature rubber bonding technologies. The same technology can be utilized for the pistonless cylinders as the radial pressure restrained device, using steel wires to replace Aramid fiber in the applications, in accordance with one embodiment.

Figure 2D:
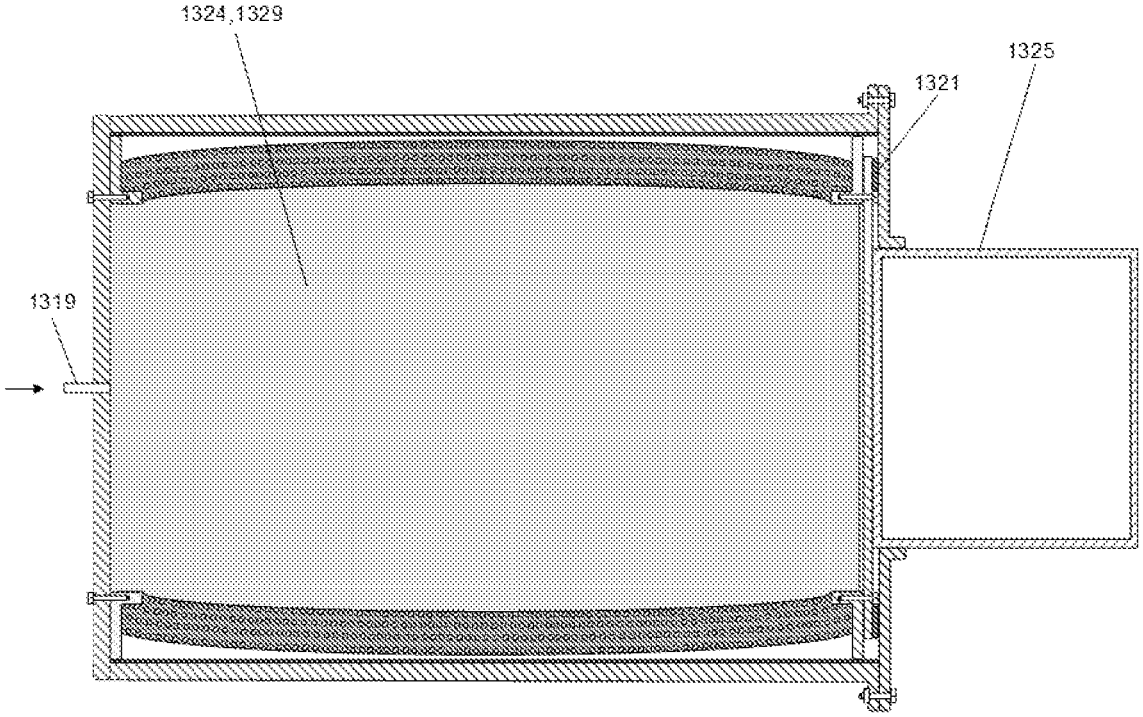
FIG. 2D illustrates a cross section view of the Improved Pistonless Cylinder assembly configuration shown in FIG. 2A in a fully extended position in accordance with one embodiment.

Referring to FIG. 2D, a cross section view to show the Improved Pistonless Cylinder, shown in FIG. 2A, in a fully extended position.

The key advantages of a Pistonless Cylinder over a conventional cylinder are listed below:

1. The main body of a Pistonless Cylinder, including the pressured chamber and the barrel, is made of flexible material such as nature rubber and Aramid fibers, not rigid material such as steel as used for conventional cylinders. The barrel in a Pistonless Cylinder is not designed to take any pressure loading but only serves as a safety device and a decoration device to be made with non-metal materials such as plexiglass or fiberglass, or with a non-circular cross section shape for the barrel such as a square shape or a rectangular shape instead in order to suit different requirements. In addition, the annular gap between the barrel inner surface and the tubular outer surface can be filled with circulating water to control the temperature at the elastomer tubular outer surface. Consequently, the total weight of a Pistonless Cylinder is significantly less than a conventional cylinder when both have the same size and the same loading capacity. In addition, the weight increase of a Pistonless Cylinder is insensitive to increase of the cylinder's internal pressure.

2. Use of reinforced fibers bonded with natural rubber as used for floating fenders, including Aramid fibers, to take high internal pressure is a mature off-the-shelf technology which has a long history of successful field applications under severe offshore environments with proven system durability and reliability and without a need of any maintenance under harsh offshore environments. In contrast, conventional cylinders require periodic maintenance with regular change of hydraulic oils and replacement of O-ring seals. In addition, the vast majority of conventional hydraulic cylinder failures are due to the failure of O-ring seals. In contrast, a Pistonless Cylinders have no O-ring seals in the system. Therefore, the overall system reliability and durability of pistonless cylinders should be much higher than conventional cylinders.

3. A Pistonless Cylinder is environmentally more friendly because it uses ordinary water like seawater or fresh water instead of oil for hydraulic fluid. In addition, it does not need lubricant oil, if any, for the function of the system.

4. For underwater applications, a Pistonless Cylinder is independent of water depth in terms of cost, unlike conventional cylinders which need assistance of a water depth compensation device to maintain their effective power output.

5. A Pistonless Cylinder enjoys considerable advantages over conventional load bearing systems, because it can be used directly as both hydraulic and pneumatic cylinders with very few, if any, adjustments because of the completely and reliably sealed chamber.

The Improved Pistonless Cylinder has all the above advantages of a Pistonless Cylinder over a conventional hydraulic cylinder.

Figure 3A:
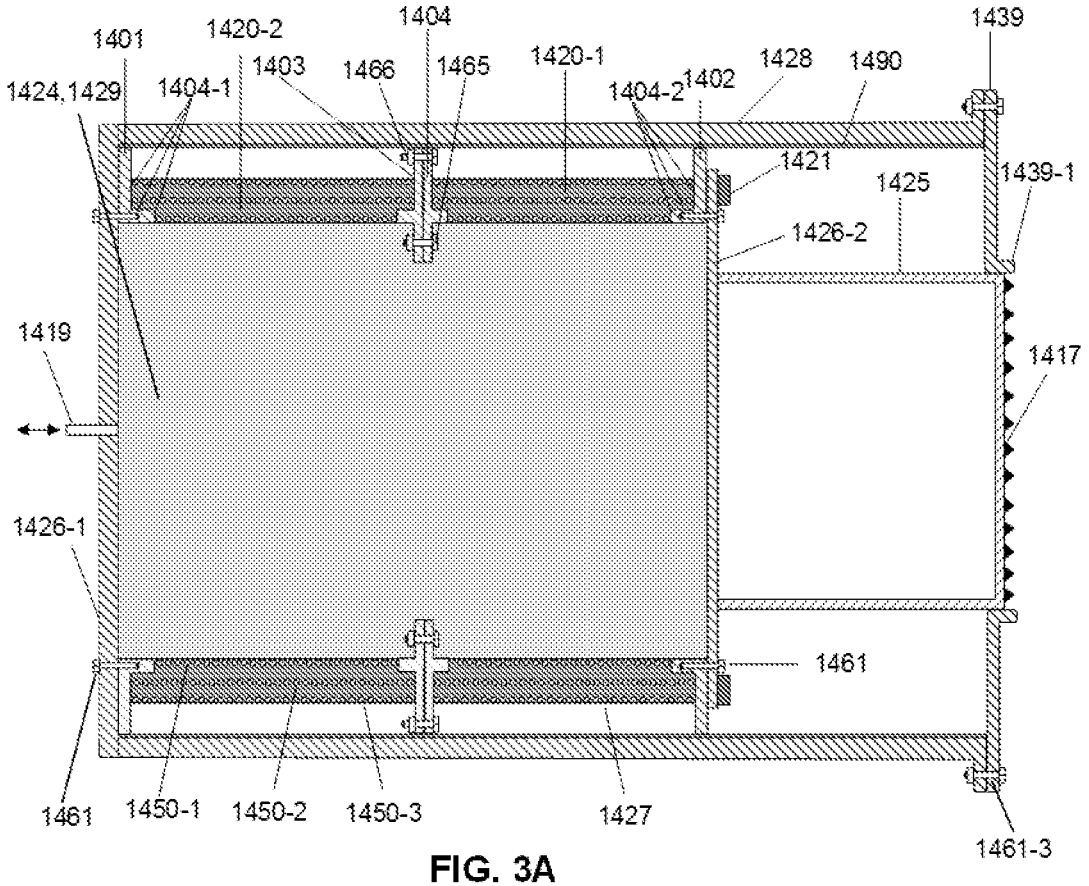
FIG. 3A illustrates a cross section view of a single acting configuration of the Improved Pistonless Cylinder assembly in a pre-activation position with two elastomer tubular units arranged in a serial configuration in accordance with one embodiment.
Figure 3B:
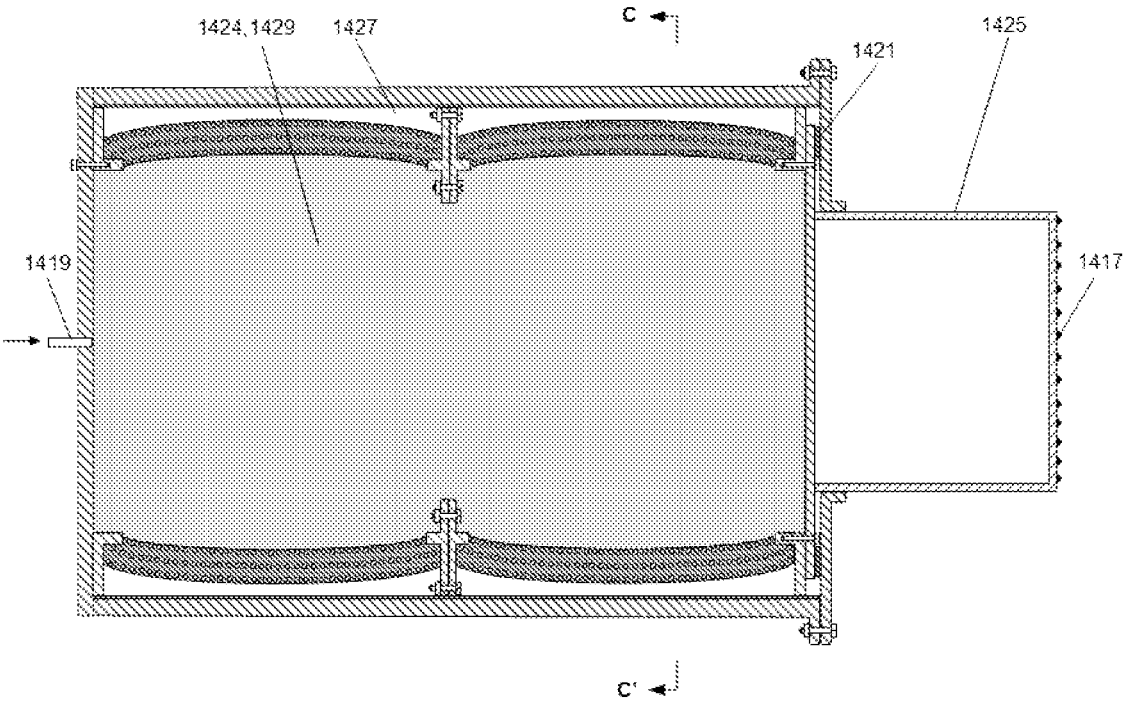
FIG. 3B illustrates a cross section view of the single acting configuration of the Improved Pistonless Cylinder assembly shown in FIG. 3A, in a fully extended position, in accordance with one embodiment.
Figure 3C:
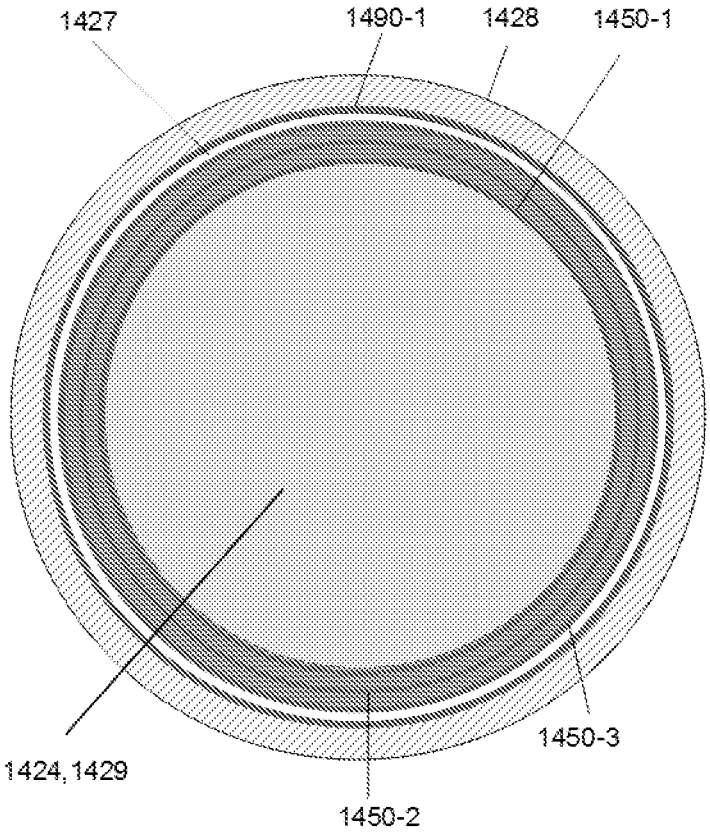
FIG. 3C illustrates the enlarged C-C' cut-off section view in FIG. 3B in accordance with one embodiment.

In accordance with one embodiment of the present disclosure, figures from FIG. 3A through FIG. 3C illustrate another configuration of the Improved Pistonless Cylinder. Compared with the one shown in FIG. 2A, the elastomer tubular, is cut into two equal length sections, which are connected in a serial configuration horizontally. The advantage of this configuration is to increase the longitudinal stiffness of the elastomer tubular 1420 in case that the elastomer tubular 1420 is so long with reduced longitudinal stiffness as to cause sagging.

Referring to FIG. 3A, a cross section view to show the Improved Pistonless Cylinder in a pre-activation position. A pair of additional ring plates with a L-shape cross section 1403 and 1404 in combination added to the ring plates 1401 and 1402 and two elastomer tubulars 1420-1 and 1420-2 to form two extendable tubulars. Connecting the two extendable tubulars together with bolted connections 1465 and 1466 in a serial configuration forms a combined piece of extendable cylinder as shown.

Referring to FIG. 3B, a cross section view to show the Improved Pistonless Cylinder, shown in FIG. 3A, in a fully extended position. Referring to FIG. 3C, a C-C' cross section view shown in FIG. 3B.

Figure 4A:
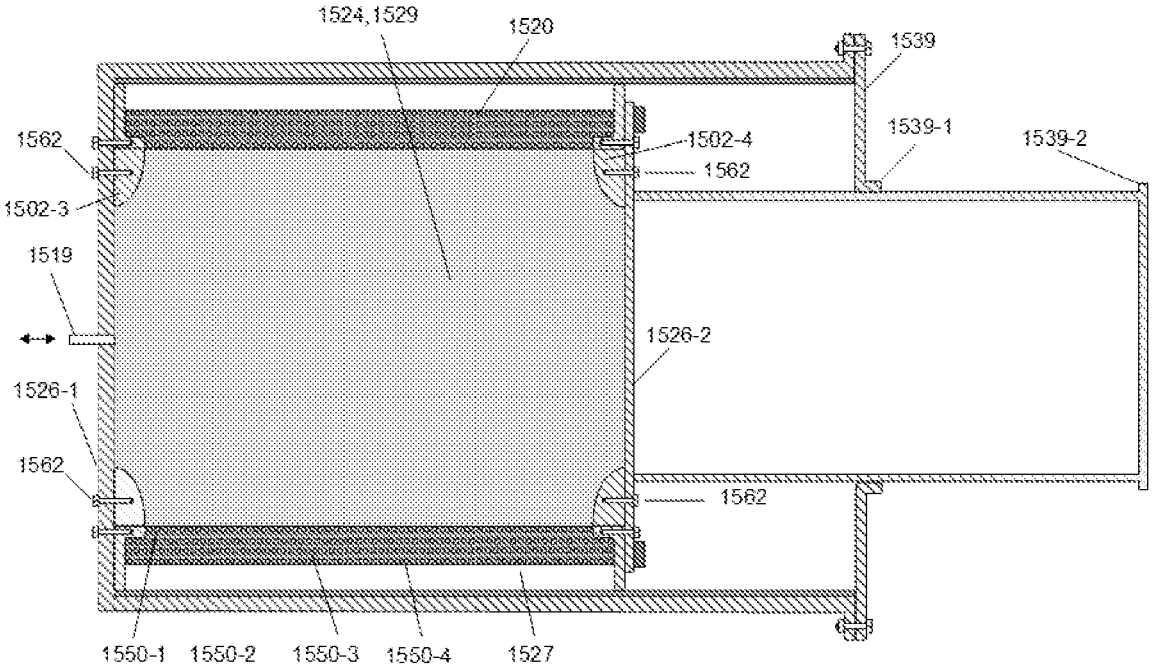
FIG. 4A illustrates a cross section view of a single acting configuration of the Improved Pistonless Cylinder assembly configuration similar to the one shown in FIG. 2A except for such additions as two guide rings and the front head with an increased stroke distance plus a return stopper for a maximum return distance in accordance with one embodiment.
Figure 4B:
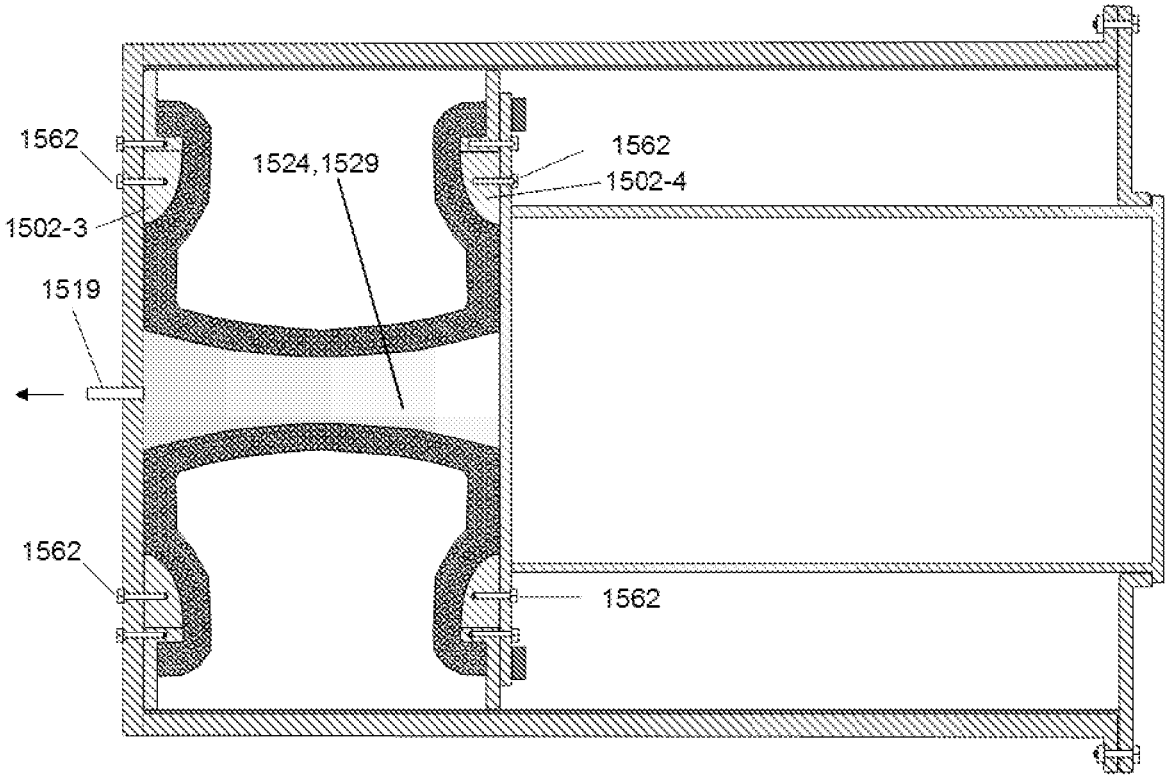
FIG. 4B illustrates a cross section view of the single acting configuration of the Improved Pistonless Cylinder assembly shown in FIG. 4A in a maximum retracted position utilizing a negative internal pressure induced suction force inside the pressure chamber in accordance with one embodiment.
Figure 4C:
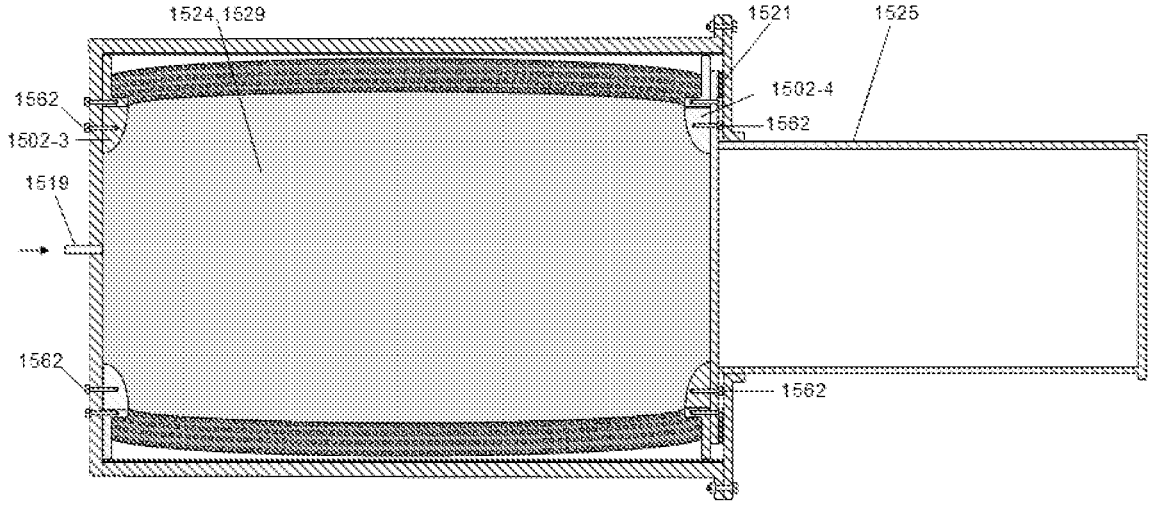
FIG. 4C illustrates a cross section view of the single acting configuration of the Improved Pistonless Cylinder assembly shown in FIG. 4A in a maximum extended position in accordance with one embodiment.

In accordance with one embodiment of the present disclosure, figures from FIG. 4A through FIG. 4C illustrate a cross section view of a configuration of the Improved Pistonless Cylinder similar to the one shown in FIG. 2A except for addition of two guide rings 1502-3 and 1502-4 and the front head 1525 with an increased stroke distance and a return stopper 1539-2, as an additional part of the traveling control system for the front head 1225 mentioned earlier, for a maximum retraction distance.

Referring to FIG. 4A, a cross section view to show a configuration of the Improved Pistonless Cylinder similar to the one shown in FIG. 2A, in a pre-activated position, except for addition of two guide rings 1502-3 and 1502-4 and the front head 1525 with an increased stroke distance and a return stopper 1539-2.

Referring to FIG. 4B, a cross section view to show the configuration of the Improved Pistonless Cylinder, shown in FIG. 4A, in a fully retracted position. A pump is able to take sufficient fluid 1529 volume out of the chamber 1524 through the supply pipe 1519 in order to create a negative pressure and a suction force inside the chamber 1524 forcing the wall of the elastomer tubular 1520 to sag inwardly toward the axis line of the chamber 1524 against both the end cap plate 1526-1 inner surface and the front cap plate 1526-2 inner surface as shown. Consequently, a maximum retraction distance is achieved.

Referring to FIG. 4C, the Improved Pistonless Cylinder shown in 4A reaches the maximum stroke distance when fluid 1529 is injected into chamber 1524 through the supply pipe 1519.

In one embodiment, the elastomer tubular may be substituted with tubular made with other flexible material.

In accordance with one embodiment of the present disclosure, figures from FIG. 5A through FIG. 5E illustrate a configuration of the Improved Pistonless Cylinder in a double acting assembly, comprising two separated pressure chambers: one forward chamber 1624-1 for cylinder extension actions and one backward chamber 1624-2 for cylinder retraction actions, respectively. This embodiment will be called Double Acting Improved Pistonless Cylinder in the present disclosure.

Figure 5A:
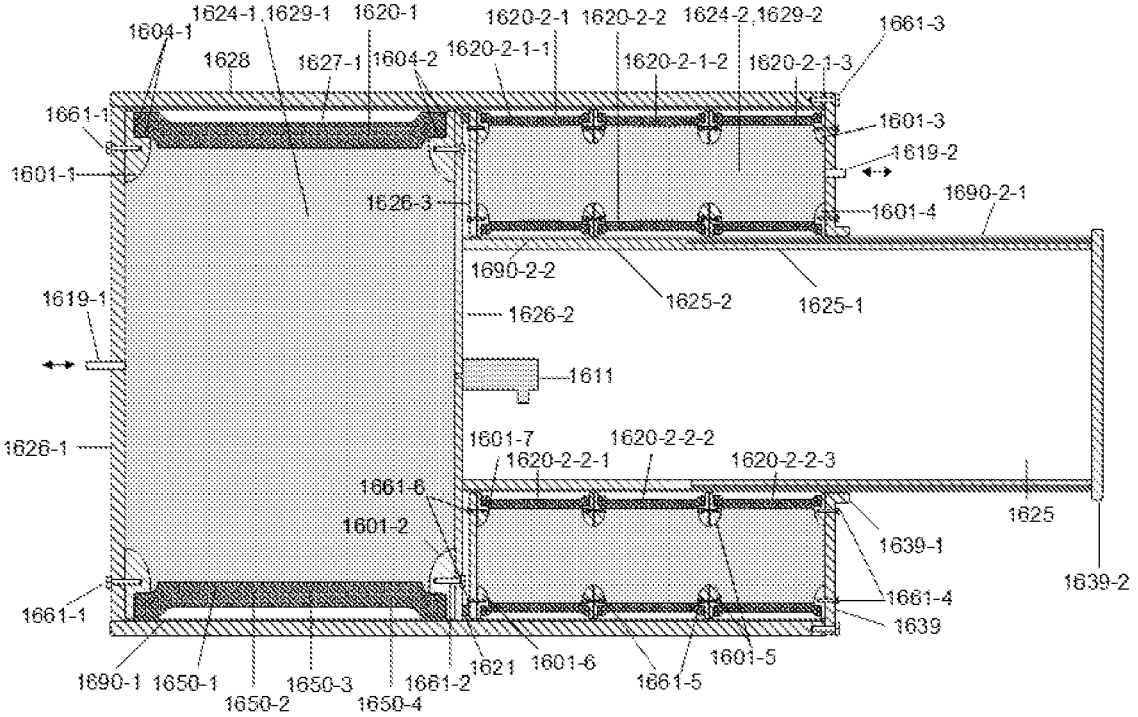
FIG. 5A illustrates a cross section view of a double acting configuration of the Improved Pistonless Cylinder assembly in a pre-activation position, with one forward pressure chamber for extension actions and the other backward pressure chamber for retraction actions, in accordance with one embodiment.
Figure 5B:
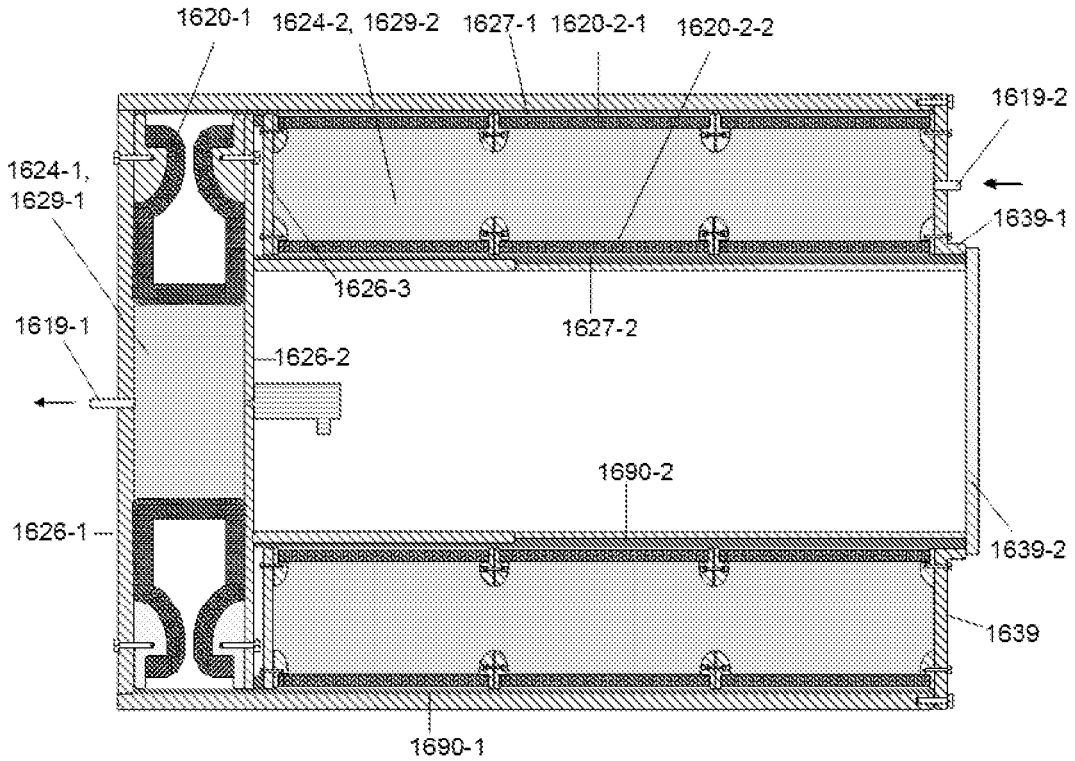
FIG. 5B illustrates a cross section view of the double acting configuration of the Improved Pistonless Cylinder assembly in a minimum stroke distance, with the forward pressure chamber in a fully retracted condition and the backward pressure chamber in a maximum extended condition, in accordance with one embodiment.

Referring to FIG. 5A, the cross-section view shows the basic configuration of the Double Acting Improved Pistonless Cylinder in a pre-activation status, with a minimum stress level inside all its elastomer tubulars, including 1620-1, three tubular sections of 1620-2-1 and three tubular sections of 1620-2-2. The elastomer tubular 1620-1 of the forward pressure chamber 1624-1 is configured with an annular middle recess section, wherein the middle recess section outer diameter is smaller than the tubular outer diameters at the two tubular ends with bonded surfaces 1604-1 and 1604-2 to the guide rings 1601-1 and 1601-2 respectively, and each guide ring plate 1601-1 or 1601-2 has an L-shaped cross section at its upper portion for bonded surfaces and a curved profile for a smooth transition at its low portion. This configuration has at least four advantages: 1) the depth of the annular middle recess can completely disappear for the elastomer tubular 1620-1 under a maximum designed internal pressure inside the forward pressure chamber 1624-1 in order to minimize the annular air gap 1627-1 width and the barrel 1628 inner surface diameter; 2) under this configuration, the pressure force in axial direction inside the pressure chamber 1624-1, acting at two cap plate (end cap plate 1626-1 and front cap plate 1626-2) inner surfaces and at the low portion inner surfaces of the two guide rings (1601-1 and 1601-2), shall have little pressure loading magnitude changes due to the radial expansion variations of the pressure chamber's (1624-1) middle tubular section; 3) the shape of these guide ring plates, 1601-1 and 1601-2, and the locations of these bonded surface areas, 1604-1 and 1604-2, can build solid bonded connections between the elastomer tubular end surfaces and the guide ring steel surfaces, 1604-1 and 1604-2, without causing inner pressure induced shear stress concerns at these bonded locations, because the guide ring protects theses bonded areas, 1604-1 and 1604-2, from the inner pressure induced shear stresses; and 4) the annular middle recess configuration for the elastomer tubular 1620-1 in the forward pressure chamber 1624-1 makes it easier to sag inwardly toward the axis line of the pressure chamber 1624-1 under the pushing force from the backward pressure chamber 1624-2, as shown in FIG. 5B. The same middle recess section configuration as mentioned above for the elastomer tubular 1620-1 is also applied to all six elastomer tubular sections (1620-2-1-1, 1620-2-1-2, 1620-2-1-3, 1620-2-2-1, 1620-2-2-2 and 1620-2-2-3) of the backward pressure chamber 1624-2.

Referring to FIG. 5A, the backward pressure chamber 1624-2 has a total of six elastomer tubular sections. The co-axially placed inner and outer elastomer tubulars, 1620-2-1 and 1620-2-2, have a total of six equal length sections (1620-2-1-1, 1620-2-1-2, 1620-2-1-3, 1620-2-2-1, 1620-2-2-2 and 1620-2-2-3) with bonded connections at the two ends of each section with corresponding guide ring plates (1601-3, 1601-4, 1601-5, 1601-6 and 1601-7) to form six sealed and bolted connections in a serial configuration for elastomer tubular 1620-2-1 and elastomer tubular 1620-2-2, respectively as shown. The same bonded connection method, as stated above for the elastomer tubular 1620-1, is utilized for all tubular 1620-2-1 and 1620-2-2 section connections. For the connections of middle tubular sections 1620-2-1-2 and 1620-2-2-2, each section has bonded connections at each end with a double guide ring plate 1601-5, which are composed of a pair of identical guide ring plates 1601-5 in a back to back configuration by bolts 1661-5, to form sealed connections. The front two guide ring plates, 1601-4 and 1601-3, are bolted together with a front L-shape ring plate 1639, as a front cap annular plate, and with the barrel 1628 front wall surface by a plurality of bolts 1661-3 and 1661-4. As for the back end of the backward pressure chamber 1624-2, two guide ring plates, 1601-6 and 1601-7, are bolted together with the end cap annular plate 1626-3 to form a completely sealed, extendable and retractable pressure chamber as the backward pressure chamber 1624-2. The backward pressure chamber 1624-2 is an annular pressure chamber, placed between the inner elastomer tubular 1620-2-2 and the outer elastomer tubular 1620-2-1, which are co-axially placed vis-à-vis each other, and within the annular room between the barrel 1628 inner surface and the front head 1625 outer surface. Other assembly details for the forward pressure chamber 1624-1 and the backward pressure chamber 1624-2 of the Double Acting Improved Pistonless Cylinder include:

1. The forward pressure chamber 1624-1 comprises a radial pressure restraining device, buried inside the elastomer tubular 1620-1 annular wall. The radial pressure restraining device comprises a plurality of Aramid fiber layers 1650-1, 1650-2, 1650-3 and 1650-4. Each Aramid fiber layer is placed between two thin rubber layers. Each Aramid fiber layer is composed of one single continuous string of Aramid fiber wrapped in a coil-like pattern around an annular thin rubber layer surface of the elastomer tubular 1620-1 from one end to the other end with a designed horizontal offset relative to the adjacent layer of Aramid fibers above or below. The bonding between the Aramid fibers and the rubber layers is through the same vulcanization process between the guide ring plates and the elastomer tubular ends as mentioned above. An equivalent radial pressure restraining device of the forward pressure chamber 1624-1 is also applied to the six elastomer tubular sections (1620-2-1-1, 1620-2-1-2, 1620-2-1-3, 1620-2-2-1, 1620-2-2-2 and 1620-2-2-3) of the backward pressure chamber 1624-2. One advantage of the radial pressure restraining device is to enhance internal pressure loading capacity. For example, a conventional hydraulic cylinder's maximum capacity to take internal hydraulic pressure force is primarily limited by its designed O-ring seal pressure loading capacity and, to a lesser extent by its barrel pressure loading capacity. In most cases, the O-ring seal pressure loading capacity is limited by the O-ring seal basic configuration as well as the material used for the O-ring seal. In a pistonless cylinder, in contrast, there is no O-ring seal and its barrel does not take internal pressure loading. Therefore, the internal pressure loading capacity of a pistonless cylinder is determined by, for example, the following factors instead: 1) the type, the string diameter of the Aramid fibers and the wrapping numbers of the fiber are combined to determine the maximum internal pressure loading strength; and 2) the wrapping pattern and the gaps between the strings of Aramid fibers below or above are combined to determined its pressure sealing capacity. Therefore, it is clear that there is no apparent upper limit of the internal pressure loading of the pressure chamber for a pistonless cylinder, and such cylinder shall be able to take higher internal pressure than a conventional O-ring seal equipped hydraulic cylinder.

2. A traveling control system for the front head 1625 comprises: 1) an L-shaped ring plate 1639 with the short arm section 1639-1 provides a unidirectional guidance and traveling distance control for the front head 1625 extension and retraction activities; 2) four pre-fixed stopper plates 1639-3, as shown in FIG. 5D, which are evenly and annularly placed, and fixed at the bottom outer surfaces of the short arm section 1639-1 of the L-shape ring plate 1639 to limit the maximum stroke distance of the front head 1625, with four grooves 1665-1 for the four stopper plates 1639-3 sliding actions in combined tubulars of a front head thin wall section 1625-1 and a UHMWPE tubular thick wall section 1690-2-1, respectively as shown in FIG. 5D; 3) a return stopper plate 1639-2 attached to the front of the front head 1625; and 4) an installed rubber ring plate 1621 at front cap plate 1626-2 outer surface in combination with the annular back cap annular plate 1626-3 to serve as a shock absorber and a stopper for maintaining a gap between the front of the forward pressure chamber 1624-1 and the back of the backward pressure chamber 1624-2.

3. For the safety of the forward pressure chamber 1624-1, a safety valve 1611 is pre-installed at the front cap plate 1626-2 front surface, inside the front head 1625 inner room and with its bottom being connected to the inside of the forward pressure chamber 1624-1. The purpose of the installed safety valve 1611 is to provide a protection for the forward pressure chamber 1624-1 from pressure overloading, because the safety valve 1611 can automatically open to release transmission medium 1629-1 to the inside room of the front head 1625 in order to reduce the internal pressure of the chamber. Once the inner pressure of the forward pressure chamber 1624-1 is reduced below a pre-set maximum pressure for the safety valve 1611, the safety valve 1611 will automatically close back to a normal operational condition. As an option, a similar safety valve can also be installed for the backward pressure chamber 1624-2, in accordance with one embodiment of the present disclosure. In accordance with one embodiment of the present disclosure, other pre-assembly of the Double Acting Improved Pistonless Cylinder activities are in the following order, in accordance with one embodiment: 1) the elastomer tubular 1620-1 is bonded to two guide ring plates 1601-1 and 1601-2, one at each end of the tubular, through a vulcanization process; 2) all six elastomer tubular sections (1620-2-1-1, 1620-2-1-2, 1620-2-1-3, 1620-2-2-1, 1620-2-2-2 and 1620-2-2-3) for the backward pressure chamber 1624-2 are also bonded individually with the corresponding guide ring plates (1601-3, 1601-4, 1601-5*s*, 1601-6, and 1601-7) through a similar vulcanization process as mentioned above; 3) the pre-assembled elastomer tubular 1620-1 is connected to a pre-installed rubber ring plate 1621 at the outer surface of the front cap plate 1626-2, which is pre-fixed at the back of the front head 1625; and 4) pre-assembled elastomer tubulars 1620-2-1 and 1620-2-2, each having three tubular sections, assembled together with all the bolted connections, including bolted annular connections between the pre-assembled elastomer tubulars 1620-2-1 and 1620-2-2 and the back cap annular plate 1626-3 at back end of these two tubulars, and bolted annular connections between the pre-assembled elastomer tubulars 1620-2-1 and 1620-2-2 and the front L-shape front guide ring plate 1639 at front end of these tubulars, utilizing a plurality of bolts 1661-3 and 1661-4.

4. The final assembly of the Double Acting Improved Pistonless Cylinder is put together in the following order, in accordance with one embodiment: 1) set up a circular sealed connection between the barrel 1628 back end inner surface and the back end cap plate 1626-1 outer circular surface with a pre-installed supply line 1619-1 at the outer surface of the back end cap plate 1626-1 for movement of transmission fluid 1624-1 into and out of the forward pressure chamber; 2) insert the UHMWPE tubular 1290-1, sliding against the inner surface of the barrel 1628 until touching the back end cap plate 1626-1; 3) insert the pre-assembled elastomer tubular 1620-1 connected with a pre-installed rubber ring plate 1621 and also attached with the front head 1625 back end at the outer surface of the front cap plate 1626-2; 4) utilize a plurality of bolts 1661-1 to have a plurality of bolted connections in an annular shape, between the end cap plate 1626-1 inner surface and the guide ring plate 1601-1, and utilize a plurality of bolts 1661-2 to have a plurality of bolted connections in an annular shape between the front end plate 1626-2 inner surface and the guide ring plate 1601-2, in order to form a completely sealed, extendable and retractable forward pressure chamber 1624-1 filled with transmission fluid 1629-1; 5) insert the UHMWPE tubular 1690-2, including a thin section 1690-2-1 matching with a front head thick wall section 1625-2 and a thick section 1690-2-1 matching with a front head thin wall section 1625-1, until touching the outer surface of the front cap plate 1626-2; 6) insert the pre-assembled elastomer tubulars 1620-2-1 and 1620-2-2 together with the pre-installed annular back cap plate 1626-3 and the pre-installed front L-shape cap annular plate 1639 until touching the pre-installed rubber ring plate 1621; 7) utilize a plurality of bolts 1661-4 to connect the guide ring plates 1601-3 and 1601-4 to the front L-shape cap annular plate 1639 inner surface in order to form a completely sealed backward pressure chamber 1624-2 filled with transmission fluid 1629-2; 8) utilize a plurality of bolts 1661-3 to connect the barrel 1628 front end to the front L-shape cap annular plate 1639 with a pre-installed supply line 1619-2 for the backward pressure chamber 1624-2 and the four stopper plates 1639-3 pre-fixed at the bottom ring surface of the short arm section 1639-1, as shown in FIG. 5D; and 9) connect a return stopper 1639-2 at the front surface of the front head 1625 to finish up the entire assembly of the Double Acting Improved Pistonless Cylinder.

Referring to FIG. 5A, in accordance with one embodiment of the present disclosure, the wrapping patterns of Aramid fiber layers (1650-1, 1650-3, 1650-3 and 1650-4) for elastomer tubulars 1620-1, can be the same as shown in FIG. 2C or in FIG. 2C-1. Similarly, the same wrapping patterns can be applied to all six elastomer tubular sections of the backward pressure chamber 1624-2. The primary advantage of selected wrapping pattern is to ensure that all assembled elastomer tubulars have a very high radial strength against high internal pressure as well as a very high stiffness in radial direction and a low stiffness in longitudinal direction. Secondly, the selected wrapping pattern satisfies elastomer tubular sealing requirements, especially when the front head 1625 is in its maximum extension position for the forward pressure chamber 1624-1, or when the front head 1625 is in its minimum extension position for the backward pressure chamber 1624-2.

Referring to FIG. 5B, the Double Acting Improved Pistonless Cylinder is in its minimum stroke condition with the return stoppers 1639-2 against the L-shaped ring plate short arm 1639-1. At this configuration, the two elastomer tubulars, 1620-2-1 and 1620-2-2, with their six sections, are all in their maximum stroke conditions, with transmission medium 1629-2 fully pumped into the backward pressure chamber 1624-2 through the supply line 1619-2. There are a couple of annular gaps, 1627-1 and 1627-2, between each elastomer tubular annular 1620-2-1 outer surface and the UHMWPE tubular 1690-1 inner surface, and between each elastomer tubular annular 1620-2-2 inner surface and the UHMWPE tubular 1690-2 outer surface for the backward pressure chamber 1624-2. For the forward pressure chamber 1624-1, the action to pump transmission fluid 1629-1 out of the forward pressure chamber 1624-1, through supply line 1619-2, is sufficient to create a suction force inside the chamber, wherein the inner chamber pressure is below the environmental pressure. In addition, the pushing action force at the front cap plate 1626-2 by the backward pressure chamber 1624-2, in combination with the suction force, shall force the elastomer tubular 1620-1 to sag inwardly toward the axis line of the chamber 1624-1 against both end cap plate inner surfaces, 1626-1 and 1626-2, respectively. Nevertheless, once the backward pressure chamber 1624-2 starts to increase its chamber pressure by injecting transmission fluid 1629-2 into the chamber, the forward pressure chamber 1624-1 shall reduce its chamber pressure to a pre-determined minimum and shall keep the flow rate sufficiently steady through the supply line 1619-1 in order to help the wall of the elastomer tubular 1620-1 to deform smoothly and evenly during the sagging action.

Figure 5C:
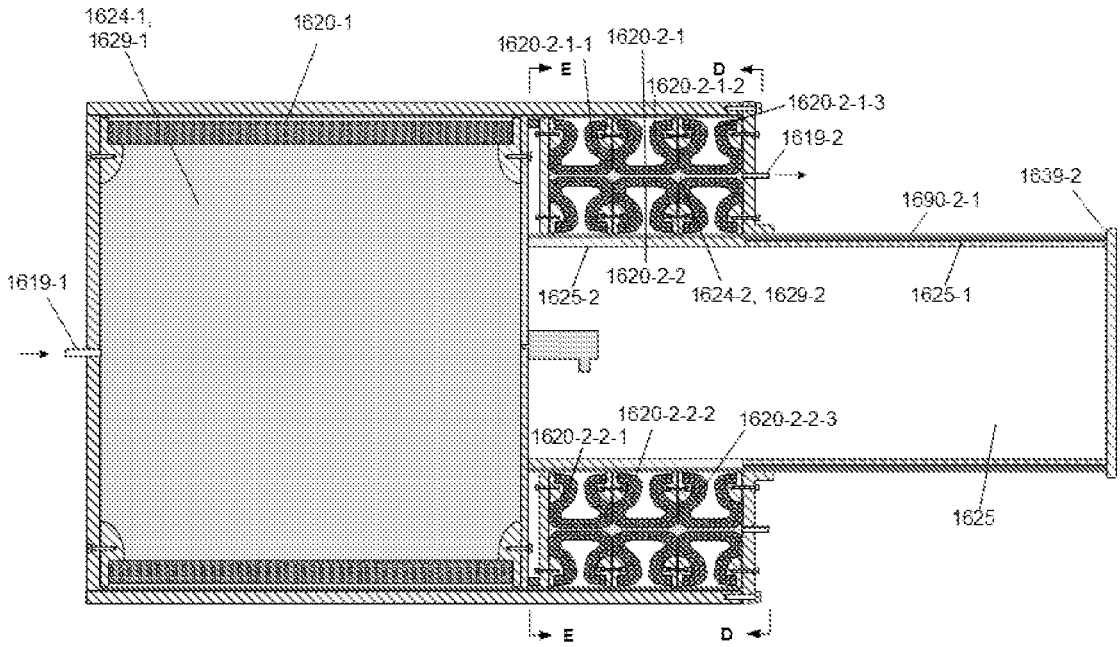
FIG. 5C illustrates a cross section view of the double acting configuration of the Improved Pistonless Cylinder assembly in a maximum stroke distance, with the forward pressure chamber in a maximum extended condition and the backward pressure chamber in a fully retracted condition, in accordance with one embodiment.
Figure 5D:
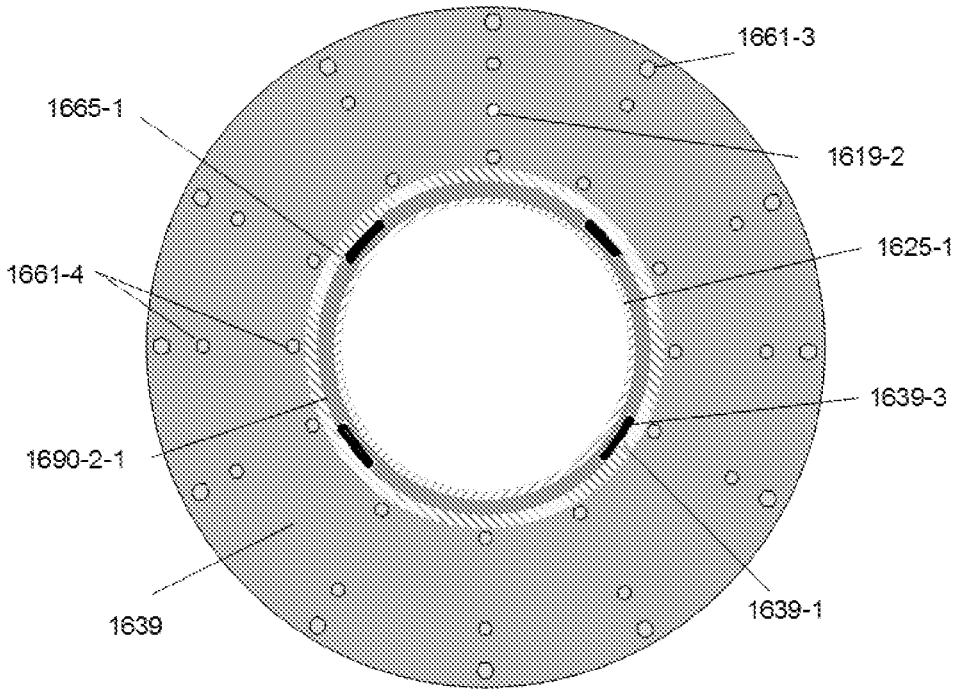
FIG. 5D illustrates the D-D' cross section view, shown in FIG. 5C, of a configuration of the Improved Pistonless Cylinder assembly, in a fully extended position, in accordance with one embodiment.

Referring to FIG. 5C, the Double Acting Improved Pistonless Cylinder is in its maximum stroke condition with each of the four stopper plates 1639-3, attached to the L-shaped ring plate short arm 1639-1 bottom, against the front head 1625 thicker wall section 1625-2 and sliding against the UHMWPE tubular thicker section 1690-2-1 groove 1665-1 bottoms, respectively, both shown in FIG. 5D. At the same time, all six elastomer tubular sections (1620-2-1-1, 1620-2-1-2, 1620-2-1-3, 1620-2-2-1, 1620-2-2-2 and 1620-2-2-3) of elastomer tubulars 1620-2-1 and 1620-2-2 for the backward pressure chamber 1624-2, are in their minimum stroke condition. The action of pumping transmission fluid 1629-2 out of the backward pressure chamber 1624-2 shall force the elastomer tubulars 1620-2-1 and 1620-2-2 with all six sections to sag inwardly toward the axis line of the chamber 1624-2, accordingly. For the forward pressure chamber 1624-1, the action of pumping transmission fluid 1629-1 through supply line 1619-1 into the front pressure chamber 1624-1 shall force the elastomer tubular 1620-1 to extend fully. Nevertheless, once the forward pressure chamber 1624-1 starts to increase its chamber pressure by injecting transmission fluid 1629-1 into the chamber, the backward pressure chamber 1624-2 shall reduce its chamber pressure to a pre-determined minimum in order to create a suction force inside the chamber 1624-2 and shall keep the flow rate sufficiently steady through the supply line 1619-2 in order to help the walls of the elastomer tubulars to deform smoothly and evenly during sagging actions, accordingly.

A conventional hydraulic system typically has four key devices at minimum: a motor to provide power input for the system, a pump to take transmission medium into and out of a cylinder in order to provide a unidirectional displacement for a piston rod, a valve, and a cylinder, in order for the system to transform hydraulic energy into mechanic energy. Commonly, a positive displacement pump is used for injecting transmission medium into and out of a conventional hydraulic cylinder without allowing formation of negative pressure inside pressure chambers for the safety of system. Based on the assumption that liquid and solid material such as steel are incompressible materials, a piston rod displacement of a cylinder can be precisely determined based on the injected volume of liquid into a cylinder pressure chamber, which is independent of internal hydraulic pressure. A control valve is then utilized to collect such data from the cylinder as total volume of transmission medium inside, internal pressure, and displacement of a piston rod, in order to determine each snapshot information of hydraulic cylinder system dynamic status.

The major differences of a pistonless hydraulic cylinder compared with a conventional hydraulic cylinder include: 1) the pressure chambers of the former are flexible both in radial and in longitudinal directions; 2) the elastomer tubular is not only extendable, but also retractable with the tubular radially sagging inwardly toward the axis line of a chamber in order to increase the cylinder maximum stroke; 3) the front head displacement is dependent not only on injected transmission medium volume, but also on a chamber inner pressure induced chamber extension and a chamber retraction induced displacement; and 4) a modified pump is able not only to inject transmission medium into a pressure chamber, but also to withdraw transmission medium from the pressure chamber in order to create a negative pressure inside the chamber. It is noteworthy that such a modified pump is easily available, based on a reversible positive displacement pump. Nevertheless, existing control valves for a conventional hydraulic cylinder in a conventional hydraulic system are not suitable for a pistonless cylinder, because additional data, such as pressure chamber expansion, extension and retraction data along a elastomer tubular entire length based on an annual gap size variations between a barrel inner surface and an elastomer tubular outer surface of a pistonless cylinder pressure chamber shall be required and collected. In accordance with one embodiment of the present disclosure, a modified control valve, configured to suit a pistonless cylinder system, shall have the ability to monitor pressure chamber outer surface shape changes, namely to collect additional data from a pistonless cylinder such as pressure chamber expansion, extension and retraction information along the entire length of each elastomer tubular, in combination with other collected data, such as transmission medium injection volume and the chamber internal pressure, in order to provide a snapshot of the hydraulic cylinder system dynamic status. In accordance with one embodiment of the present disclosure, these data collecting sensors can be installed at the inner surfaces of a barrel and the outer surface of an elastomer tubular over the entire length of the elastomer tubular, because the barrel of a pistonless cylinder does not take internal pressure induced loading and the barrel can be made of non-metal materials and in different cross-section shapes, such as square shape or rectangular shape, thus facilitating installation of such sensors.

It should be pointed out that when deployed under water with seawater or fresh water as its transmission fluid, a pistonless cylinder enjoys some obvious advantages over conventional hydraulic cylinders, as exampled by one embodiment of the present disclosure. When deployed for deepwater applications, a conventional hydraulic cylinder usually has to rely on a water depth compensator for different water depth applications. A pistonless cylinder can, in contrast, operate independently regardless of water depths without a need for water depth compensation. As another advantage, in the case of a Double Acting Improved Pistonless Cylinder deployed underwater, its forward and backward pressure chamber loading areas at front and back cap plates and guide rings can be configured differently to suite different pressure loading requirements. For example, water depth related water pressure can be utilized to reduce the relevant requirement for the backward pressure chamber annular loading area. When seawater is pumped out of the forward pressure chamber in the underwater environment to create a negative pressure inside the chamber relative to the surrounding water, doing so actually creates three pushing forces, in addition to the pushback force from the backward pressure chamber: 1) water pressure force from the annular outer surface of the elastomer tubular to sag inwardly toward the axis line of the chamber and to pull back the front cap plate of the forward pressure chamber; 2) water pressure force induced pressure force acting at a front head front surface and annular surface of a front cap plate to pull back the front cap plate of the forward pressure chamber; and 3) an elastic returning force created by the elastomer tubular wall of the forward pressure chamber to pull back the front cap plate of the forward pressure chamber. In some deepwater applications, moreover, single acting pistonless cylinders can substitute for double acting pistonless cylinders to further simplify the hydraulic system and to reduce overall costs, in accordance with one embodiment of the present disclosure.

Referring to FIG. 5D, it is the D-D' cross section view shown in FIG. 5C. A plurality of bolts 1661-3 are utilized for annular bolted connections between the barrel 1628 front and the L-shape ring plate 1639, as shown in FIG. 5A. A plurality of bolts 1661-4 are utilized for annular bolted connections between the L-shape ring plate 1639 and the guide ring plates 1601-3 and 1601-4, as shown in FIG. 5A. A supply line 1619-2 is pre-installed at the L-shape ring plate 1639 outer surface, with the short arm section 1639-1 as the guide for the front head 1625. Four return stopper plates 1639-3 are evenly spaced and circumferentially fixed at the bottom of the short arm section 1639-1, sliding against the groove 1665-1 bottom surfaces, in the UHMWPE tubular thick wall section 1690-2-1 matching with the front head thin wall section 1625-1.

Figure 5E:
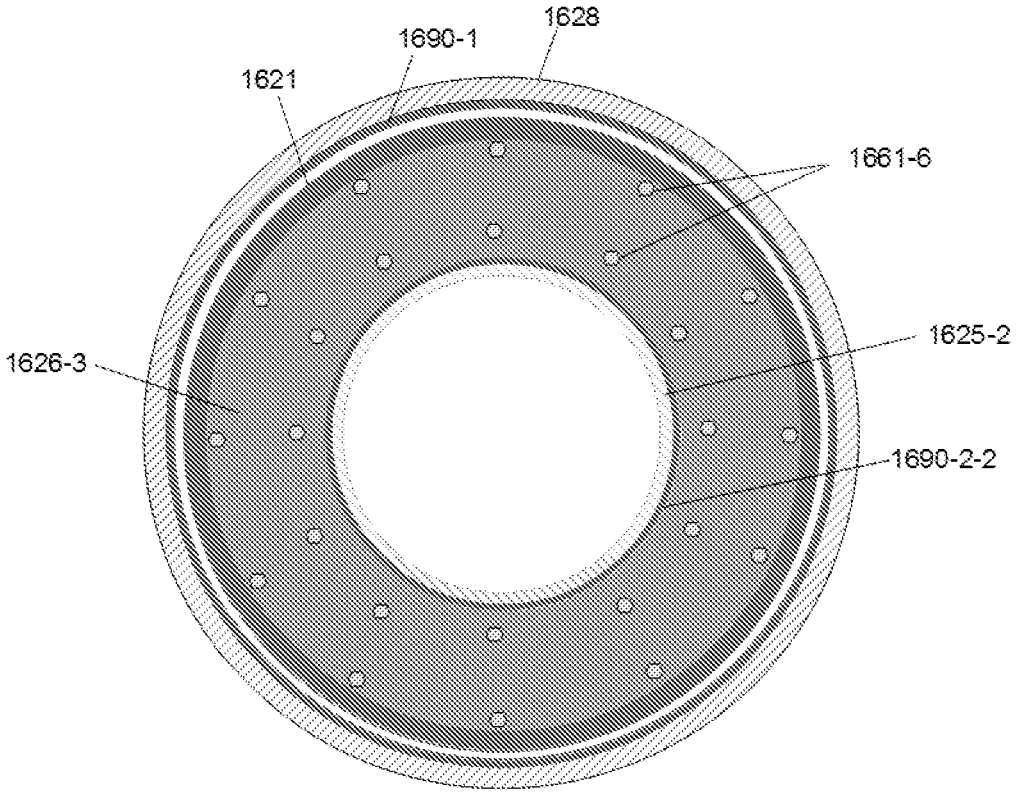
FIG. 5E illustrates the E-E' cross section view, shown in FIG. 5C, of a configuration of the Improved Pistonless Cylinder assembly, in a fully extended position, in accordance with one embodiment.

Referring to FIG. 5E, it is the E-E' cross section view shown in FIG. 5C. A UHMWPE tubular 1690-1 is inserted against the inner surface of the barrel 1628, for the friction reduction and noise reduction purposes, when guide ring plate outer surfaces slide against the inner surface of the UHMWPE tubular 1690-1. A rubber ring plate 1621 is attached at the outer surface of the front cap plate 1626-2 and a plurality of bolts 1661-6 are utilized to connect the back cap annular plate 1626-3 with the guide ring plates 1601-6 and 1601-7, as shown in FIG. 5A, wherein the guide ring plate 1601-6, with its outer annular surface, slides against the inner surface of the UHMWPE tubular 1690-1 and the guide ring plate 1601-7, with its inner annular surface, slides against the outer surface of the UHMWPE tubular thin wall section 1690-2-2 where it matches with the front head thick wall section 1625-2.

Finally, it should be pointed out that any steel surfaces inside the chamber of the assembly exposed to water in all the embodiments listed above should be properly treated with anticorrosion painting or coating, because pistonless cylinders use water instead of oil as their hydraulic fluids.

Although a limited number of embodiments of the load bearing and power transmission device, including both single and double acting configurations, in accordance with the present invention have been described herein, those skilled in the art will recognize that various substitutions and modifications may be made to the specific features described above without departing from the scope of the invention as recited in the appended claims.

What is claimed is:

1. A load bearing and power transmission device, comprising:

(i) at least one extendable and retractable unit, each of said extendable and retractable unit comprising:

a) a flexible tubular (1220);

b) a plurality of reinforced fiber layers (1250), each of said fiber layer is wrapped in a coil-like wrapping pattern around said flexible tubular (1220) from one end to another end with a horizontal offset relative to an adjacent layer of reinforced fiber above or below;

c) a pair of ring plates (1201, 1202), each ring plate is connected to each end of said flexible tubular; and d) an end cap plate (1226-1) and a front cap plate (1226-2) each having a sealed connection to the back and front respectively of said extendable and retractable unit to form a completely sealed, extendable and retractable chamber (1224) for transmission medium, wherein said chamber has no sliding surface inside the chamber;

(ii) a traveling control device for providing a unidirectional guidance and traveling distance control of the front head (1225); and (iii) a supply line (1219) for taking transmission medium into and out of the chamber (1224), said supply line comprises one end that is connected to the inside of the chamber (1224) and another end that is connected to a nearby device.

2. The load bearing and power transmission device according to claim 1, wherein the flexible tubular is an elastomer tubular.

3. The load bearing and power transmission device according to claim 2, wherein said elastomer tubular is divided into two or more sections, wherein each end of said section is in a bonded connection to a ring plate, and said sections are horizontally connected end to end in a serial configuration.

4. The load bearing and power transmission device according to the claim 3, wherein each of the elastomer tubular section has an annular middle recess section with its tubular section outer diameter smaller than the tubular section outer diameters at the tubular two ends.

5. The load bearing and power transmission device according to claim 3, wherein the horizontal connection between two elastomer tubular sections is made by bolting end to end between a pair of ring plates.

6. The load bearing and power transmission device according to claim 1, wherein the reinforced fiber is Aramid fiber.

7. The load bearing and power transmission device according to claim 1, further comprising:

(i) a plurality of curved plates (1290-2), each of which is able to slide at a surface of another plate both longitudinally and annularly;

(ii) a tubular plate (1290-1) having an outer surface against an inner surface of the barrel (1228);

(iii) an annular gap (1227) between an inner surface of said tubular plate (1290-1) and an outer surface of said curved plates (1290-2), wherein the annular gap (1227) comprises a width sufficient for avoiding any contact between said tubular plate (1290-1) and said curved plates (1290-2) under a pre-activation condition;

(iv) a barrel (1228) for housing the completely sealed chamber (1224);

(v) a second annular gap (1227) between an inner surface of the barrel (1228) and an outer surface of the flexible tubular (1220); and (vi) one safety valve, connected to the inside of the extendable and retractable chamber for the protection of the chamber from inner pressure overloading.

8. The load bearing and power transmission device according to claim 7, where the barrel (1228) has a non-circular cross section shape and/or is made of non-metal materials.

9. The load bearing and power transmission device according to claim 1, wherein the device is a hydraulic cylinder, the transmission medium is water, and the supply line is connected to a pump.

10. The load bearing and power transmission device according to claim 9, wherein the water is sea water, and the pump is an underwater pump.

11. The load bearing and power transmission device according to claim 1, wherein the device is a pneumatic cylinder, the transmission medium is air, and the supply line is connected to an air compressor.

12. The load bearing and power transmission device according to claim 1, wherein sufficient transmission medium is taken out of the chamber (1224) to create a suction force inside the chamber forcing the wall of the extendable and retractable unit to sag inwardly toward the axis line of the chamber.

13. The load bearing and power transmission device according to claim 1, wherein the coil-like wrapping pattern is a parallel pattern.

14. The load bearing and power transmission device according to claim 1, wherein the coil-like wrapping pattern is a crisscrossing coil-like wrapping pattern with a maximum crisscross angle less than 8 degrees.

15. The load bearing and power transmission device according to claim 1, wherein the device comprises one forward pressure chamber and one backward pressure chamber, wherein the forward pressure chamber (1624-1) comprises:

(i) at least one extendable and retractable unit, comprising:

a) a flexible tubular (1620-1);

b) a plurality of reinforced fiber layers, each of said fiber layer is wrapped in a coil-like wrapping pattern around said flexible tubular (1620-1) from one end to another end with a horizontal offset relative to an adjacent layer of reinforced fiber above or below;

c) a pair of ring plates (1601-1, 1601-2), each ring plate is connected to each end of said flexible tubular; and d) an end cap plate (1626-1) and a front cap plate (1626-2) each having a sealed connection to the back and front respectively of said extendable and retractable unit to form a completely sealed, extendable and retractable forward pressure chamber (1624-1) for transmission medium;

(ii) a supply line (1619-1) for taking transmission medium into and out of the forward pressure chamber, said supply line is connected to a nearby device, and wherein the backward pressure chamber (1624-2) comprises:

(i) an inner flexible tubular (1620-2-1) co-axially placed inside an outer flexible tubular (1620-2-2), said inner flexible tubular and outer flexible tubular are each divided into two or more sections that are horizontally connected end to end in a serial configuration;

(ii) a plurality of reinforced fiber layers, each of said fiber layer is wrapped in a coil-like wrapping pattern around said inner and outer flexible tubular (1620-2-1, 1620-2-2) from one end to another end with a horizontal offset relative to an adjacent layer of reinforced fiber above or below;

(iii) two pairs of ring plates (1601-3, 1601-4), each pair of ring plates is connected to each end of said inner flexible tubular section and said outer flexible tubular section respectively;

(iv) an end cap annular plate (1626-3) and a front cap annular plate (1639) each having a sealed connection to the back and front respectively of said co-axially placed inner and outer flexible tubulars to form a completely sealed, extendable and retractable backward pressure chamber (1624-2) for transmission medium; and (v) a supply line (1619-2) for taking transmission medium into and out of the backward pressure chamber, said supply line is connected to a nearby device, wherein the device further comprises a traveling control device providing a unidirectional guidance and traveling distance control of the front head (1625); and a barrel (1628) for housing the completely sealed, extendable and retractable forward pressure chamber (1624-1) and backward pressure chamber (1624-2).

16. The load bearing and power transmission device according to claim 15, wherein each of the flexible tubulars 1620-1, 1620-2-1, and 1620-2-2 is an elastomer tubular.

17. The load bearing and power transmission device according to claim 15, wherein the flexible tubular (1620-1) of forward pressure chamber is divided into two or more sections, wherein each end of said section is connected to a ring plate, and said sections are horizontally connected end to end in a serial configuration.

18. The load bearing and power transmission device according to claim 15, further comprising at least one safety valve for protecting the forward pressure chamber or the backward pressure chamber from inner pressure overloading.

19. The load bearing and power transmission device according to claim 15, wherein sufficient transmission medium is taken out of the forward pressure chamber or the backward pressure chamber to create a suction force inside said chamber forcing the wall of one of said flexible tubular to sag inwardly toward the axis line of said chambers.

20. The load bearing and power transmission device according to claim 15, wherein the transmission medium is water or air.

* * * * *